US012089719B2

(12) United States Patent
Frances et al.

(10) Patent No.: US 12,089,719 B2
(45) Date of Patent: Sep. 17, 2024

(54) CONNECTION SYSTEM FOR AN ASSEMBLY

(71) Applicant: Lauren Frances, Inc., Los Angeles, CA (US)

(72) Inventors: Lauren Frances, Los Angeles, CA (US); Albert P. Ros, New York, NY (US)

(73) Assignee: Lauren Frances, Inc., Los Angeles, CA (US)

( * ) Notice: Subject to any disclaimer, the term of this patent is extended or adjusted under 35 U.S.C. 154(b) by 278 days.

(21) Appl. No.: 17/695,313

(22) Filed: Mar. 15, 2022

(65) Prior Publication Data

US 2022/0287441 A1 Sep. 15, 2022

Related U.S. Application Data

(60) Provisional application No. 63/161,066, filed on Mar. 15, 2021.

(51) Int. Cl.
*A45D 44/00* (2006.01)
*B65D 21/02* (2006.01)

(52) U.S. Cl.
CPC ..... *A45D 44/00* (2013.01); *B65D 21/0201* (2013.01); *B65D 21/0209* (2013.01); *A45D 2200/00* (2013.01); *A45D 2200/25* (2013.01)

(58) Field of Classification Search
CPC .... A45D 33/00; A45D 33/006; A45D 33/008; A45D 33/18; A45D 33/20; A45D 33/26; A45D 33/28; A45D 2200/00; A45D 2200/25; A45D 44/00; B65D 21/0204; B65D 21/0201; B65D 21/0202; B65D 21/0233; B65D 2313/04
USPC ..... 220/23.4, 23.2, 23.6, 23.83, 23.86, 230
See application file for complete search history.

(56) References Cited

U.S. PATENT DOCUMENTS

| | | | | |
|---|---|---|---|---|
| 4,555,020 | A * | 11/1985 | Campello | A45D 33/28 206/823 |
| 2009/0320874 | A1* | 12/2009 | Boye | A45D 33/20 132/295 |
| 2011/0132508 | A1* | 6/2011 | Castellucci | A45C 13/10 150/113 |
| 2017/0013940 | A1* | 1/2017 | Harry | A45D 33/28 |
| 2018/0263361 | A1* | 9/2018 | Langdon | A45D 33/20 |
| 2019/0008261 | A1* | 1/2019 | Olivari | A45D 34/00 |
| 2019/0059557 | A1* | 2/2019 | Kehoe | A45D 40/24 |
| 2019/0110578 | A1* | 4/2019 | Maurin | A45D 40/24 |

(Continued)

*Primary Examiner* — Cris L. Rodriguez
*Assistant Examiner* — Karim Asqiriba
(74) *Attorney, Agent, or Firm* — Lombard & Geliebter LLP; Eric J. Huang, Esq.

(57) ABSTRACT

A system for releasably connecting a plurality of interchangeable components in an assembly. The system includes a plurality of units and a plurality of interchangeable components capable of being releasably joined to one or more of the plurality of units. The plurality of units further includes a physical connecting system and a magnetic connecting system for relative positioning of at least one of the plurality of units with at least another one of the plurality of units. The physical connecting system includes a set of physical keys. The set of physical keys includes an indentation and projection on the surface of the unit. The magnetic connecting system includes a plurality of magnetic connectors housed in the interior housing of each of the plurality of units.

19 Claims, 16 Drawing Sheets

(56) References Cited

U.S. PATENT DOCUMENTS

| | | | | |
|---|---|---|---|---|
| 2020/0146421 | A1* | 5/2020 | Chen | A45D 33/008 |
| 2021/0022480 | A1* | 1/2021 | Sobol | A45D 40/24 |

* cited by examiner

CONNECTION SYSTEM FOR AN ASSEMBLY

CROSS-REFERENCE TO RELATED APPLICATION

This application claims the benefit of U.S. Provisional Patent Application No. 63/161,066 filed Mar. 15, 2021, which is incorporated by reference herein in its entirety.

FIELD OF THE APPLICATION

The present application relates generally to a connection system for an assembly, and more particularly to a system for releasably connecting a plurality of interchangeable components in an assembly using a system of magnetic and physical connectors, and more particularly to a cosmetic holder assembly for holding a plurality of cosmetic containers using a system of magnetic connectors and physical keys.

BACKGROUND OF THE APPLICATION

Cosmetics are a major industry with numerous product types, such as lipstick, mascara, foundation, powder palates for eyeshadows, blushes and highlighters, lip gloss, eyeliner, nail polish, etc., that come in containers of all shapes and sizes. There is a desire by cosmetics users to be able to carry a variety of products on their person throughout the day in their purse, tote bag, etc. Due to the large number of products a consumer may want to carry, and the variety of sizes and shapes in which they come, it can be difficult to store, transport, and access the products in a convenient, organized, and efficient manner While various attempt to create cosmetic holder assemblies have been made by others, often they are bulky and not conducive to being assembled in a light and compact form ideal transport in a bag, and are costly to manufacture due to the excessive use of plastic or other materials. The current systems and devices for assembling cosmetics or other products together therefore fail to account for a user's needs. Accordingly, there is a need for a cosmetic holder assembly that is not so limited.

SUMMARY OF THE INVENTION

The present application addresses and resolves or otherwise ameliorates one or more of the disadvantages or limitations of the previously known connection systems for an assembly.

A connection system for an assembly is provided. In one aspect, a system for releasably connecting a plurality of interchangeable components in an assembly is provided. The system includes a plurality of units. Each of the plurality of units includes a first exterior surface, a second exterior surface, a first interior surface, a second interior surface, an interior housing of the unit defined by at least the first and second interior surfaces, and a first end having a first coupling component. The system also includes a plurality of interchangeable components. Each of the interchangeable components includes a second coupling component capable of being releasably joined to one or more of the plurality of units. The plurality of units further includes a physical connecting system for relative positioning of at least one of the plurality of units with at least another one of the plurality of units. The physical connecting system includes a first set of physical keys on each of the plurality of units. The first set of physical keys includes a first indentation on the first exterior surface of the unit, and a first projection on the second exterior surface of the unit and dimensionally complementary to the first indentation. The first projection on one of the plurality of units is capable of fitting into the first indentation on another one of the plurality of units, such that the physical connecting system is capable of causing at least one of the plurality of units to be releasably joined to another one of the plurality of units along a first plane. The plurality of units further includes a magnetic connecting system for relative positioning of at least one of the plurality of units with at least another one of the plurality of units. The magnetic connecting system includes a plurality of magnetic connectors housed in the interior housing of each of the plurality of units. Each of the magnetic connectors has two magnetic polar zones having opposite polarity. The plurality of magnetic connectors includes a first magnet housed adjacent to the first interior surface of the unit and a second magnet housed adjacent to the second interior surface of the unit. The first magnet includes a first face facing the first interior surface and having a first polarity, and the second magnet comprises a second face facing the second interior surface and having a second polarity opposite the first polarity, such that the magnetic connecting system is capable of causing at least one of the plurality of units to be magnetically joined to another one of the plurality of units along the first plane.

In one aspect, each of the plurality of units further includes a third interior surface and fourth interior surface, and the interior housing of the unit is further defined by at least the third interior surface and fourth interior surface. The plurality of magnetic connectors further includes a third magnet housed adjacent to the third interior surface of the unit, and a fourth magnet housed adjacent to the fourth interior surface of the unit. The third magnet includes a third face facing the third interior surface and having a polarity the same as the polarity of the first face, and the fourth magnet includes a fourth face facing the fourth interior surface and having a polarity opposite the polarity of the third face and the same as the polarity of the second face, such that the magnetic connecting system is further capable of causing at least one of the plurality of units to be magnetically joined to another one of the plurality of units along a second plane perpendicular to the first plane.

In one aspect, each of the plurality of magnetic connectors are located at about a midpoint of the unit.

In one aspect, the first indentation and first projection are on a first axis of the unit perpendicular to the first and second exterior surfaces.

In one aspect, the physical connecting system includes a second set of physical keys on each of the plurality of units. The second set of physical keys includes a second indentation on the first exterior surface of the unit and a second projection on the second exterior surface of the unit and dimensionally complementary to the second indentation. The second indentation and second projection are on a second axis of the unit perpendicular to the first and second exterior surfaces and parallel to the first axis. The second projection on one of the plurality of units is capable of fitting into the into the second indentation on another one of the plurality of units such that the physical connecting system is capable of causing at least one of the plurality of units to be releasably joined to another one of the plurality of units along the first plane.

In one aspect, the first and second indentations are generally across from each other on the first exterior surface and the first and second projections are generally across from each other on the second exterior surface.

In one aspect, the first set of physical keys is offset from about a midpoint of the unit.

In one aspect, the first coupling component on each of the plurality of units includes a recessed cavity within the unit defining a socket dimensioned and configured to be releasably coupled to a complementarily dimensioned and configured post on each of the interchangeable components, and the second coupling component on each of the interchangeable components includes one or more posts dimensioned and configured to be releasably coupled to one or more complementarily dimensioned and configured sockets in the one or more of the plurality of units.

In one aspect, the plurality of units further includes a first group of one or more units whose first and second exterior surfaces are each of a fixed length and a second group of one or more units whose first and second exterior surfaces are each of a length that is a whole number multiple of the fixed length.

In one aspect, each of the plurality of units further includes a third and fourth exterior surface. The third and fourth exterior surfaces of the first group of one or more units are of a fixed length and the third and fourth exterior surfaces of the second group of one or more units are of a length that is a whole number multiple of the fixed length.

In one aspect, the magnetic connectors in the magnetic connecting system are positioned and configured in a two-dimensional square matrix pattern such that the polarity of the magnetic connectors causes adjacent units to be magnetically joined together in a consistent orientation throughout the assembly.

In one aspect, the physical connecting system is configured to prevent rotation of adjacent units relative to one another.

In one aspect, the system further includes a decoration that, when the assembly is in an assembled configuration, spans across at least a portion of a face of the assembly. The face of the assembly includes a surface of at least one of the plurality of units and a surface of at least one of the plurality of interchangeable components. The decoration provides a means to control orientation of the plurality of units and plurality of interchangeable components.

In one aspect, the decoration is selected from the group consisting of logos, trademarks, graphics, illustrations, photographs, drawings, designs, or other artwork, characters, text, letters, numbers, shapes, symbols, and combinations thereof.

In one aspect, the interchangeable components include cosmetics and personal care products and containers configured for holding and dispensing cosmetics and personal care products.

In one aspect, the unit is generally in the shape of a rectangular brick.

BRIEF DESCRIPTION OF THE DRAWINGS

In the drawings, where like reference characters denote corresponding or similar elements throughout the various figures.

DETAILED DESCRIPTION OF PREFERRED EMBODIMENTS

Figure 1:
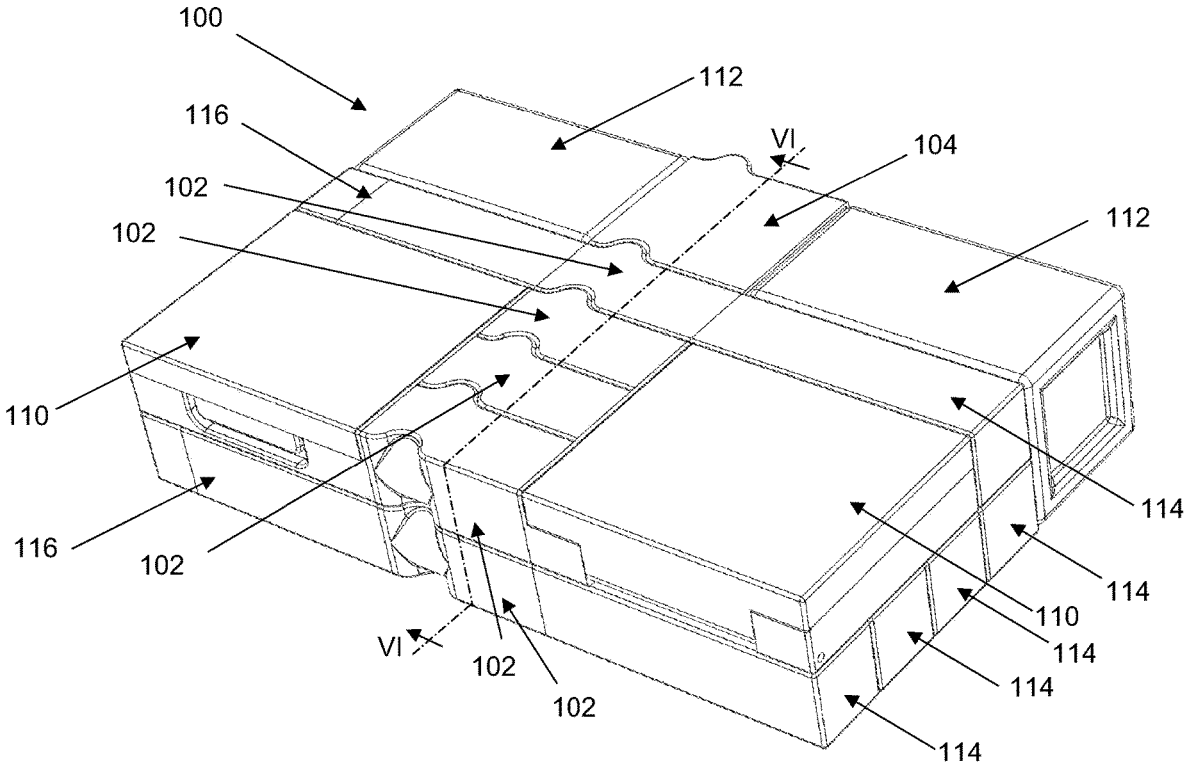
FIG. 1 illustrates a front, top, right perspective view of a cosmetic holder assembly in accordance with an exemplary embodiment of the systems and devices disclosed herein.

In various exemplary embodiments thereof, the cosmetic holder assembly of the present application addresses and resolves one or more of the drawbacks of previously known cosmetic holder assemblies, while at the same time providing significant additional benefits and advantages.

In this regard, a cosmetic holder assembly is provided that includes a plurality of stackable center bricks or units, having a magnetic and physical connecting system and a plurality of interchangeable components of various sizes and shapes that releasably attach to the plurality of center bricks by means of sockets in the bricks that are dimensioned and configured to releasably receive a complementary post of a corresponding component component in a friction-fit manner. Although primarily discussed herein in the context of cosmetics, the systems and devices disclosed herein may be used to assemble or hold other products, containers, or components and is therefore not limited thereto. Additionally, it is to be understood that the term center brick as used herein is not intended to be limiting as to the shape, size, dimensions, or relative position thereof and that embodiments with units of varying shape, size, and dimensions may be used without departing from the scope of the present invention.

The cosmetic holder assembly includes a plurality of center bricks joined by a magnetic and physical connecting system. Each brick includes a set of magnetic connectors housed inside the brick positioned and configured in a two-dimensional square matrix pattern such that the polarity of the magnets causes adjacent bricks to be to magnetically joined together in a consistent orientation throughout the assembly. Each brick additionally includes at least one set of physical keys, consisting of an indentation and a protrusion on or in the surface of the brick, offset from the midpoint of the brick, such that one brick can fit into an adjacent brick in an interlocking manner by joining, or inserting, an indentation on one brick with, or into, a complementary protrusion on an adjacent brick.

The magnetic connectors and physical keys, together, are configured to control the orientation of the bricks, such that adjacent bricks may stack neatly atop one another in both a horizontal and vertical direction. Thus, while the order in which bricks are stacked may be changed by the user, the orientation of the bricks are fixed relative to one another. Flipping or reversing a brick relative to an adjacent brick will cause adjacent bricks to not fit or join together.

The cosmetic holding assembly also includes a plurality of interchangeable components of various sizes and shapes that releasably attach to the ends of the plurality of center bricks using a socket-and post attachment method. The interchangeable components may be any of a various array of products, containers, and components for use by the user. The cosmetic holding assembly preferably includes an assortment of cosmetic products and corresponding cosmetic-holding containers, such as lipstick, lip gloss, eyeliner, mascara, eyeshadow palette, bronzers, and highlighter, along with self-fillable containers suitable for solid and liquid products or any type, like lotions, perfume, oils, shampoo, etc. The interchangeable components may be pre-filled with product, such as perfumes, body oils, lotions, and any skincare product, or may come as empty units, to be self-filled by the user with whatever products they like. Thus, the cosmetic holder assembly is not limited to just one type of product, and can come as a complete skincare and beauty set, or be added or subtracted, to adjust to the consumer's needs.

The assembly is scalable to allow for products of various sizes and may accordingly include center bricks and components of various sizes. Thus, one component may be configured for attaching to one brick of one size, while another component may be configured for attaching to a plurality of adjacent bricks of one size assembled in a grid of various sizes, such as 2×1, or 3×1, or 2×2, while yet another component may be configured for attaching to a single brick that is equivalent in size to a 2×2 grid of bricks.

The magnetic and physical connecting system of the cosmetic holding assembly causes the cosmetic holding assembly to be configured to be stackable for easy storage and transport. The cosmetic holding assembly can expand or reduce in size based on the user's need and preference, allowing for easy transport. Additional products or components can be added to the assembly by adding additional center bricks as needed. The user can mix and match the desired products or components and select the location of each product or component, based on the user's preference, creating his or her own customized assembly, or an assembly containing various combinations of products can be created and provided to consumers based on market demands. The components can be refillable or reordered based on the customer's usage, providing for an environmentally friendly that reduces container waste.

In a preferred embodiment, the cosmetic holding assembly also has a graphic image on the front and back of each piece that functions like a jigsaw puzzle to help users reassemble the kit, providing a toy-like feature to the assembly. The graphic image further provides a means of orientation control for the cosmetic holding assembly.

Referring now to FIG. 1, an exemplary embodiment of a cosmetic holder assembly is shown. The cosmetic holder assembly 100 includes a plurality of stackable center bricks 102, 104 having a magnetic and physical connecting system and a plurality of interchangeable components 110, 112, 114, 116 of various sizes and shapes that releasably attach to the plurality of center bricks. The cosmetic holder assembly may include any number and type of stackable center bricks 102, 104 and interchangeable components 110, 112, 114, 116 and other interchangeable components as described herein. As shown in FIG. 1, interchangeable components 110, 112, 114, 116 are all attached to center bricks 102, 104.

Figure 2A:
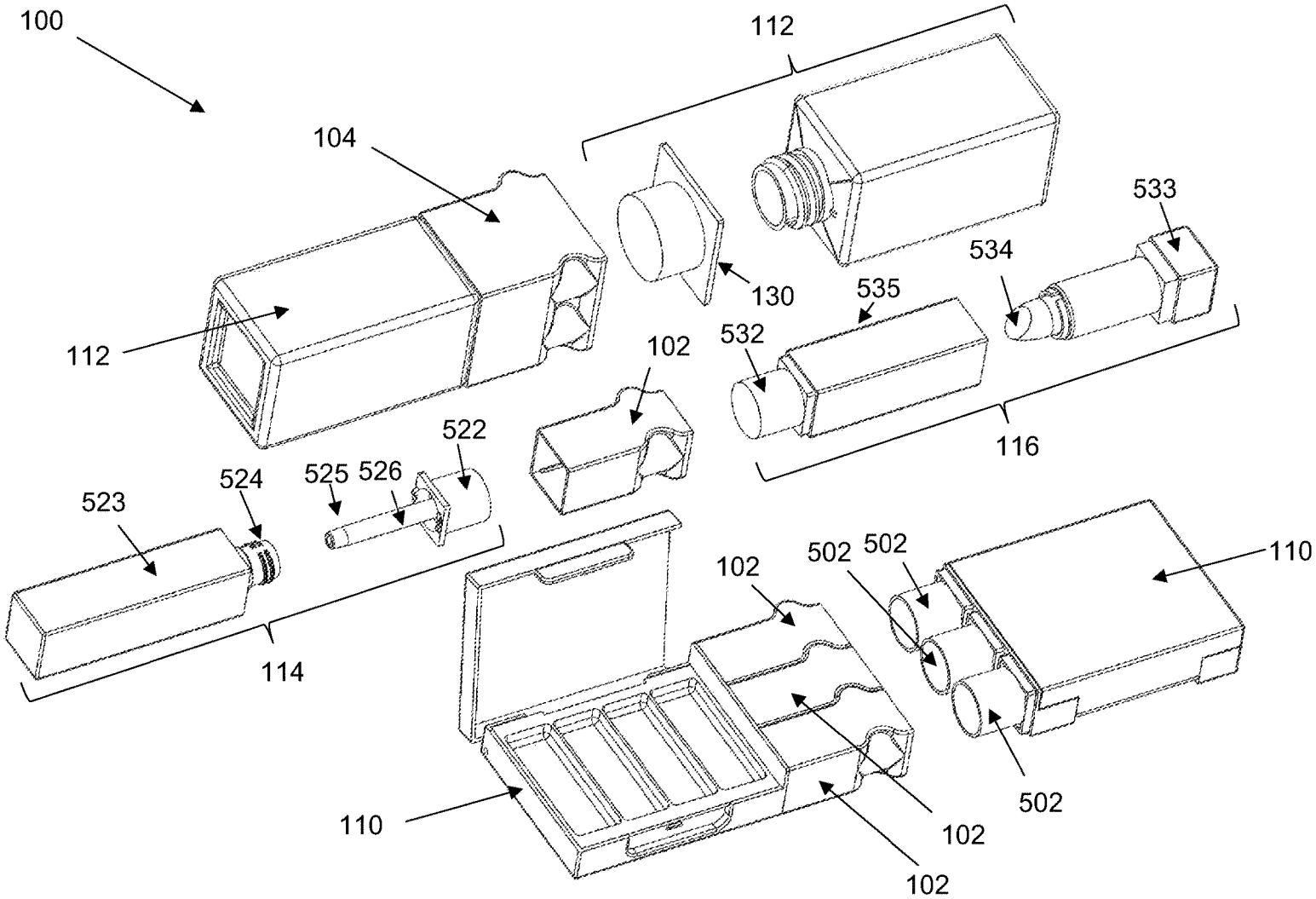
FIG. 2A illustrates a front, top, left exploded perspective view of portions of the cosmetic holder assembly of FIG. 1 in accordance with an exemplary embodiment of the systems and devices disclosed herein.
Figure 2B:
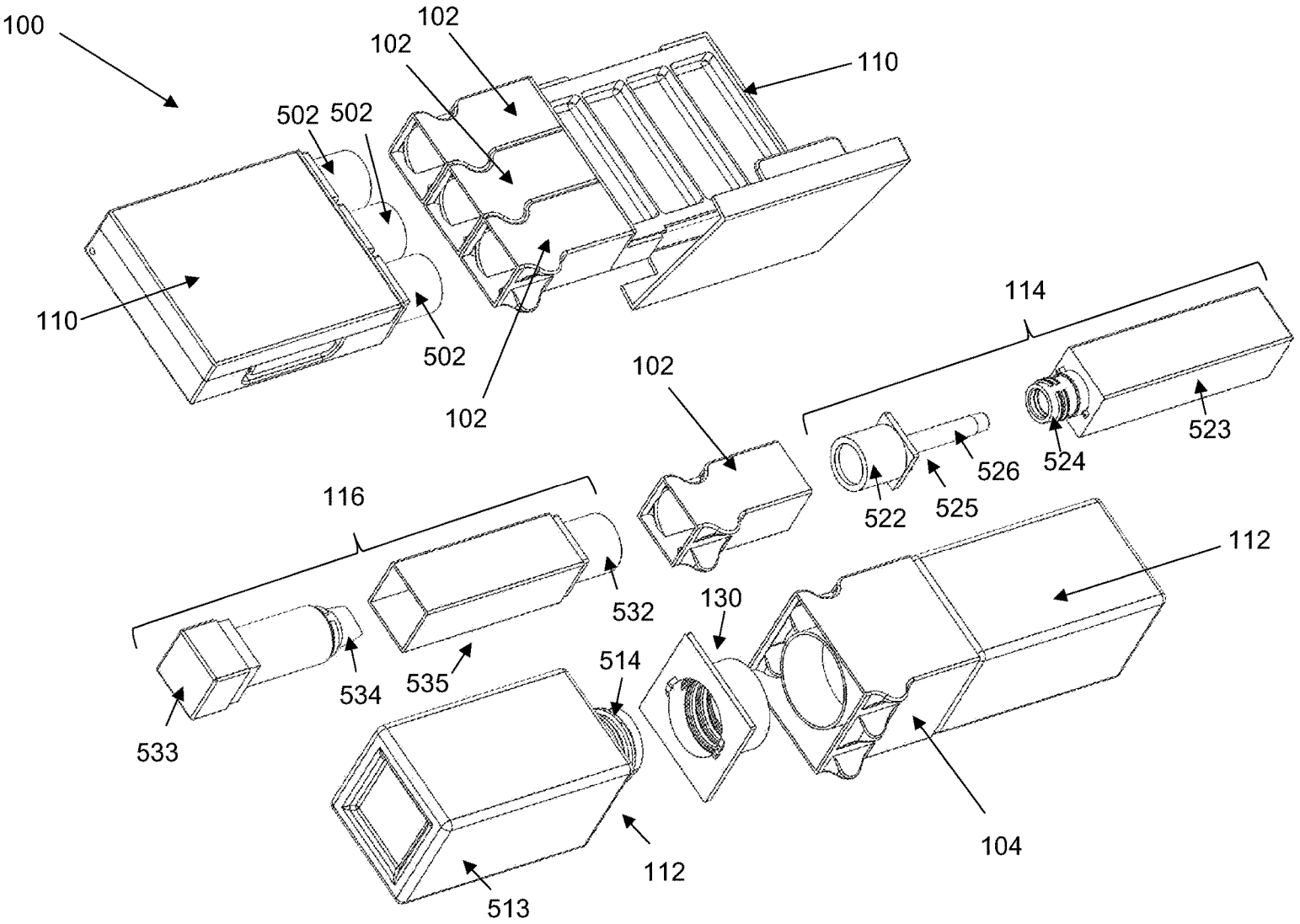
FIG. 2B illustrates a rear, top, right exploded perspective view of portions of the cosmetic holder assembly of FIG. 1 in accordance with an exemplary embodiment of the systems and devices disclosed herein.

Referring now to FIGS. 2A-2B, an exploded view of portions of an exemplary embodiment of a cosmetic holder assembly is shown. Portions of the cosmetic holder assembly 100 include a plurality of stackable center bricks 102, 104 and a plurality of compacts in an open and closed position 110, a plurality of bottles with screw caps 112, a plurality of bottles with an applicator device 114, and a lipstick with cover 116. As shown in FIG. 2, one of the bottles 112 is attached to the brick 104 and one compact 110 is attached to brick 102, while the remaining components 110, 112, 114, 116 are released from the center bricks 102 or 104. The components may be released from the center brick so that the user may access the contents of the container components.

Referring now to FIGS. 3A-3D, an exemplary embodiment for the center brick is shown. The brick 102 is generally in the shape of a rectangular prism having a top surface 202, a bottom surface 204, two side surfaces 206, 208, and two opposing ends 210, 212. Each of the two opposing ends 210, 212 has a recessed cavity formed within the brick defining a socket 214, 216 for releasably receiving a complementarily configured post of a container component 110, 112, 114, 116, or other component. The sockets are dimensioned and configured to releasably receive a complementary post of a corresponding container component in a friction-fit manner. In one embodiment, one of the two opposing ends 210, 212 of the brick 102 may not have a socket 214, 216, and instead may have a covered or otherwise capped end in place of a socket; thus, the brick may be a single-ended brick configured to releasably receive a post only at one end.

In one embodiment, the socket may include any of a combination of molded edges, extensions, and columns configured to releasably receive a complementary post of a corresponding container component in a friction-fit manner. In FIGS. 3A-3F, the sockets 214, 216 on ends 210, 212 include molded extensions 220 located in the cavities of the brick at the corners formed by the intersection of the surfaces 202, 204, 206, and 208. Additionally, the socket 214 on end 210 further includes a curved molded edge 222 located in the cavity of the brick on the internal side of three of the surfaces 202, 204, 206, and 208.

In a preferred embodiment, the cosmetic holding assembly may contain center bricks of various sizes. In one embodiment, the assembly contains a quad center brick 104 whose top, bottom, and side surfaces are twice the width of those of the center brick 102 shown in FIGS. 3A-3F, while the length from end 310 to end 312 is the same as that 210, 212 of the center brick 102. As discussed herein, center brick 102 may alternatively be identified as a 1×1 brick, while the quad center brick 104 show in FIGS. 4A-4F may alternatively be identified as a 2×2 brick.

Referring now to FIGS. 4A-4F, an exemplary embodiment for the quad center brick is shown. The brick 104 is generally in the shape of a rectangular prism having a top surface 302, a bottom surface 304, two side surfaces 306, 308, and two opposing ends 310, 312. Each of the two opposing ends 310, 312 has a recessed cavity formed within the brick either defining a socket, or within which a socket is located, for releasably receiving a complementarily configured post of a container component 110, 112, 114, 116, or other component. The sockets are dimensioned and configured to releasably receive a complementary post of a corresponding container component in a friction-fit manner. In FIGS. 4A-4F, a socket 314, 316 is located in a recessed cavity in each of the two opposing ends 310, 312. In one embodiment, one of the two opposing ends 310, 312 of the brick 104 may not have a socket 314, 316, and instead may have a covered or otherwise capped end in place of a socket; thus, the brick may be a single-ended brick configured to releasably receive a post only at one end.

In one embodiment, the socket may include any of a combination of molded edges, extensions, and columns configured to releasably receive a complementary post of a corresponding container component in a friction-fit manner. In FIGS. 4A-4F, the sockets 314, 316 on ends 310, 312 include molded cylindrical walls 320, 322 located in the cavities of the brick and attached to the internal body of the brick.

Figure 5A:
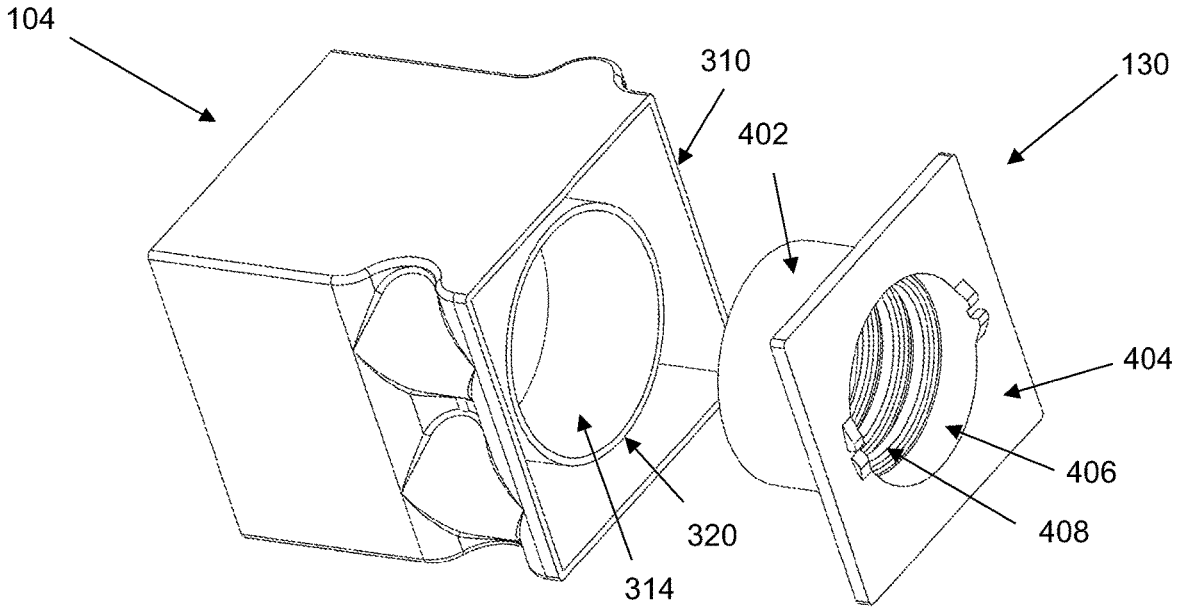
FIG. 5A illustrate front, bottom, left perspective view of a snap-in cap for a quad brick in accordance with an exemplary embodiment of the systems and devices disclosed herein.
Figure 5B:
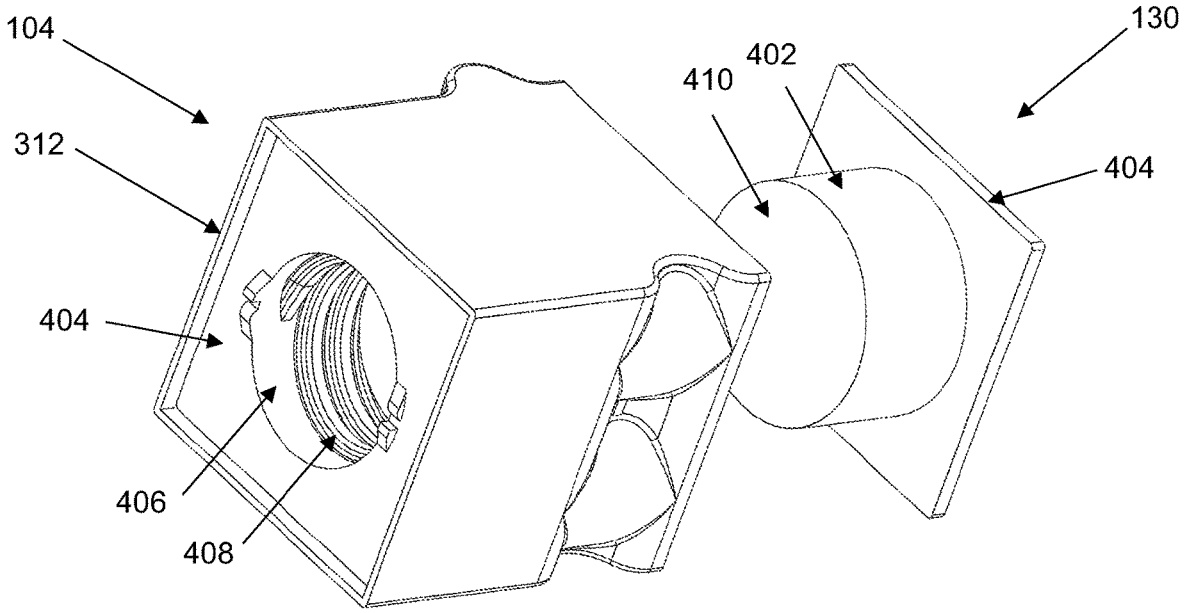
FIG. 5B illustrates front, bottom, right perspective view of a snap-in cap for a quad brick in accordance with an exemplary embodiment of the systems and devices disclosed herein.

In one embodiment, the sockets in center brick 102 and quad center brick 104 may include a snap-in cap. Referring now to FIGS. 5A-5B, an exemplary embodiment for a snap-in cap for a quad brick is shown. The snap-in cap 130 includes a hollow cylindrical wall 402 and a flat base surface 404 perpendicular to the wall. The snap-in cap may have a flat top surface 410 perpendicular to the wall 402 and enclosing the top of the cap, or the top of the cap may be hollow. The cap 130 is inserted wall-first into a socket 314, 316 in an end 310, 312 of the brick (or similarly into socket 214, 216 in an end 210, 212) and fixed into place using conventional and known methods, such as snap-fit assembly methods, such that the base surface 404 is flush with, or slightly recessed below, the end 310, 312 of the brick. The interior surface 406 of the cylindrical wall 402 may be threaded 408, such that a container having a neck that is complementarily threaded may screw onto the threaded cap. Thus, a container may be opened and released from the brick by unscrewing the container from the snap-in cap, and reclosed and connected to the brick by screwing the container to the snap-in cap. In this manner, the post of the container is effectively permanently fixed inside the brick's socket.

Figure 5C:
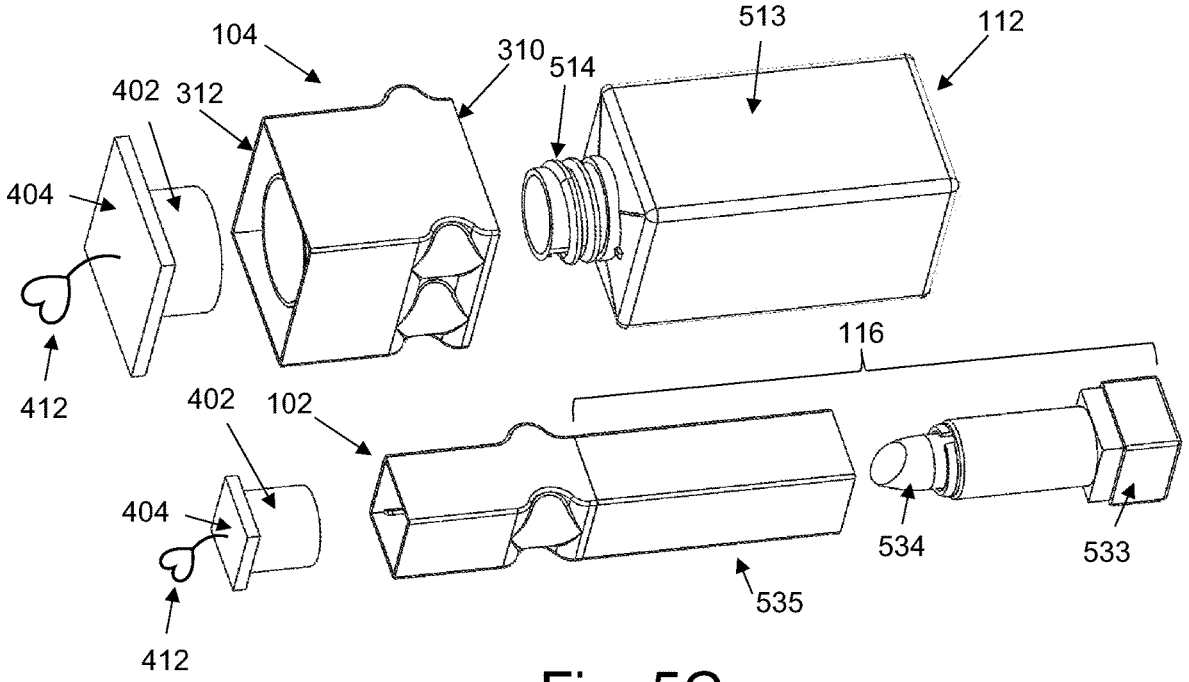
FIG. 5C illustrates a rear, bottom, left perspective view of snap-in caps for a center brick and quad center brick of a cosmetic holder assembly in accordance with an exemplary embodiment of the systems and devices disclosed herein.

In one embodiment, the brick may be a single-ended brick configured to releasably receive a post only at one end. Referring now to FIG. 5C, an exemplary embodiment for snap-in caps for a single-ended center brick and single-ended quad center brick is shown. In a single-ended brick, one of the two opposing ends 210, 212 and 310, 312 of respective bricks 102, 104 lacks a socket. Instead, the socket-less end 210 or 212 and 310 or 213 may be capped, flat, rounded, dome shaped, solidly filled, contain an ornament or other decorative feature, or may be configured in any other manner in the absence of a socket, and enclosing what would otherwise be an accessible cavity. In an embodiment for a single-ended brick with a capped end, the capped end may be a snap-in cap 131 similar to snap-in cap 130, except the flat base surface 404 encloses the cylindrical wall 402 and thus the bottom of the cap, forming an enclosed end, rather than an open end having a socket. A charm, chain, handle, ornament or other decorative feature 412 may be attached to the base surface 404. Similarly, multiple bricks 102, 104 may be joined by a chain feature to keep them from getting lost or misplaced.

While the post and socket are preferably coupled using a friction-fit, other conventional and well known methods for coupling the post and socket may be employed, such as mechanical, magnets, screw threads, snap-fit, Velcro, etc. The post and socket function as a modular assembly device similar to the post and socket snap fit on Lego bricks. Thus, the post of any container component can be releasably received and coupled with the socket of any center brick.

As described herein, interchangeable components 110, 112, 114, 116 and others of various sizes and shapes may include a post, such as 502, 522, 532 for releasably attaching to the center brick at the socket. Generally, the post may be integrated into the body of a component or dually function as a cap to a component. For example, for bottle components, the post may be built into the bottle cap, whereas, with other components, such as a compact, one or more posts may be built into the body of the body of the compact. Each component includes attached or coupled at one end or elsewhere on the component one or more posts that are dimensioned and configured to be releasably inserted into one or more corresponding complementary sockets in one or more bricks, as described above. The one or more posts may be molded to the body of the container or component or may be attached or coupled to the body by any conventional and known means, such as adhesive, socket and peg or Velcro.

In a preferred embodiment, the post is round or cylindrical, and the socket is preferably configured to allow for insertion and removal of the complementary post without restriction to axial rotation of the post. In other embodiments, the post may be of any shape, including rectangular, triangular, hexagonal, oval, or another any other shape, enclosed or otherwise, suitable for performing the functions described herein, and the socket may be configured accordingly to receive such a post.

Alternatively, as previously described, the post for a container may actually be a threaded snap-in cap that is secured in the socket of a brick. The container may have a neck that is complementarily threaded to screw onto the threaded cap. Thus, a container may be opened and released from the brick by unscrewing the container from the snap-in cap, and reclosed and connected to the brick by screwing the container to the snap-in cap.

Figure 3A:
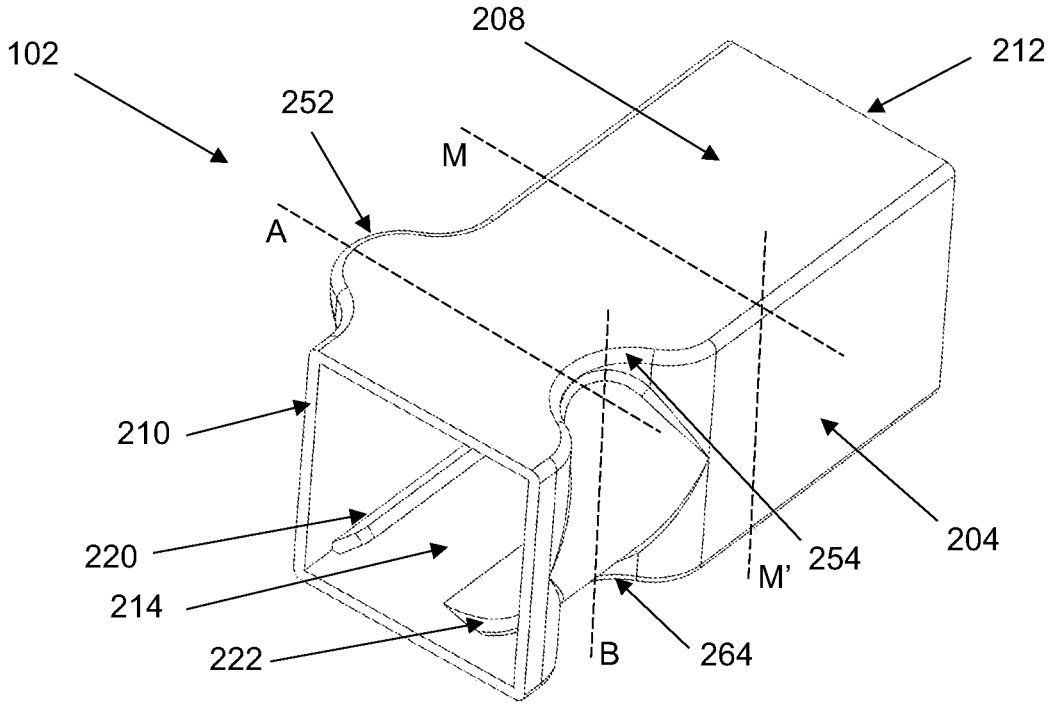
FIG. 3A illustrates a front, bottom, right perspective view of a center brick of a cosmetic holder assembly in accordance with an exemplary embodiment of the systems and devices disclosed herein.
Figure 3B:
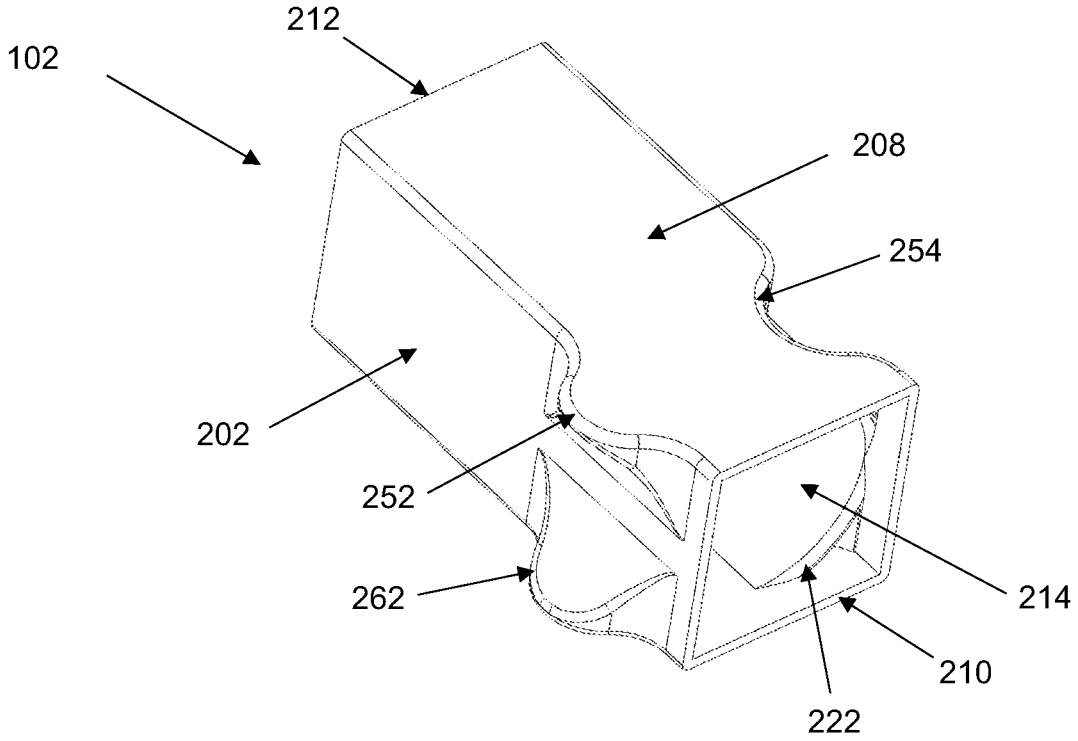
FIG. 3B illustrates a front, top, right perspective view of a center brick of a cosmetic holder assembly in accordance with an exemplary embodiment of the systems and devices disclosed herein.
Figure 3C:
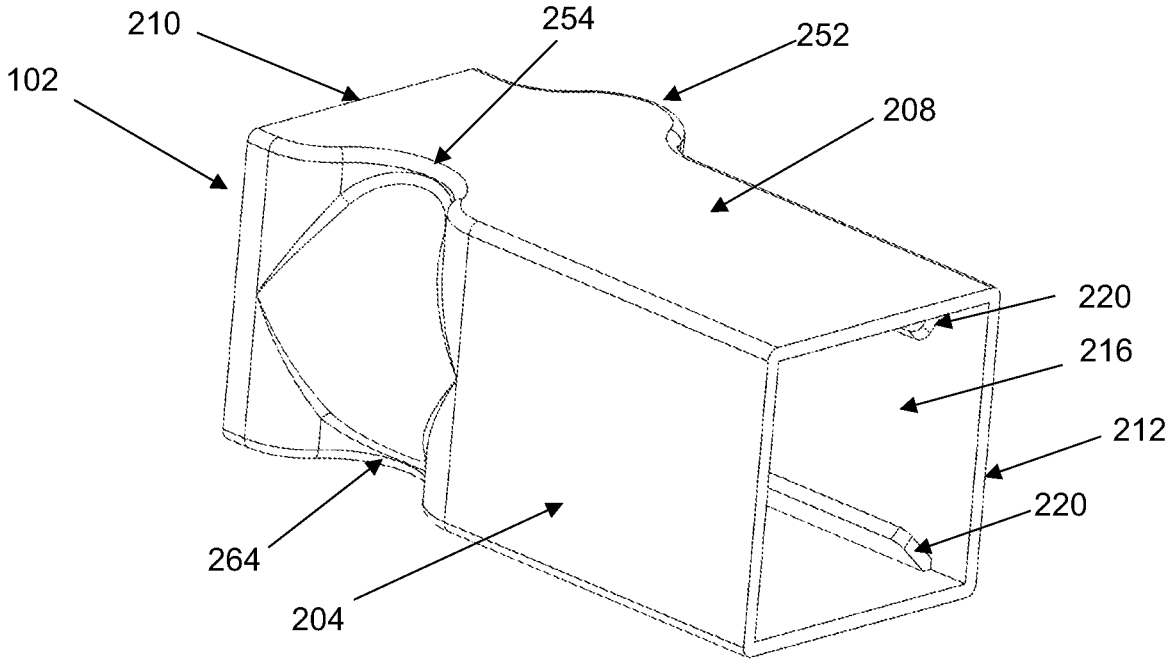
FIG. 3C illustrates a rear, bottom, right perspective view of a center brick of a cosmetic holder assembly in accordance with an exemplary embodiment of the systems and devices disclosed herein.
Figure 3D:
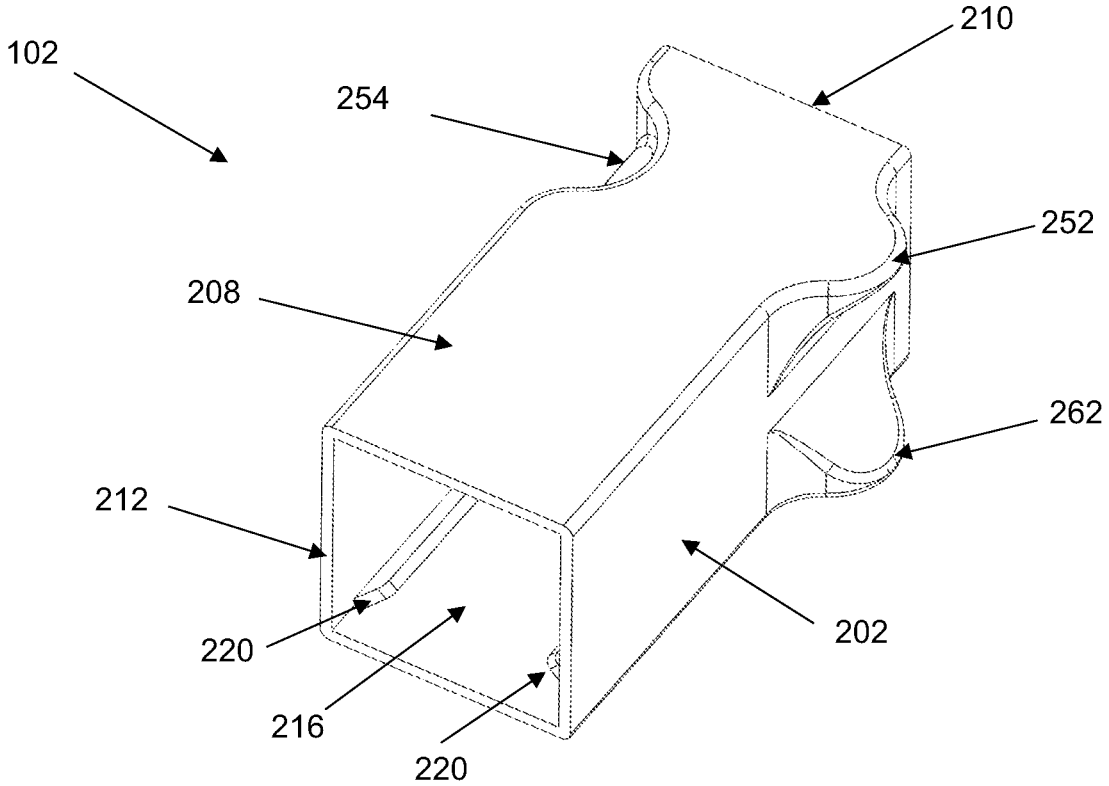
FIG. 3D illustrates a rear, top, right perspective view of a center brick of a cosmetic holder assembly in accordance with an exemplary embodiment of the systems and devices disclosed herein.
Figure 3E:
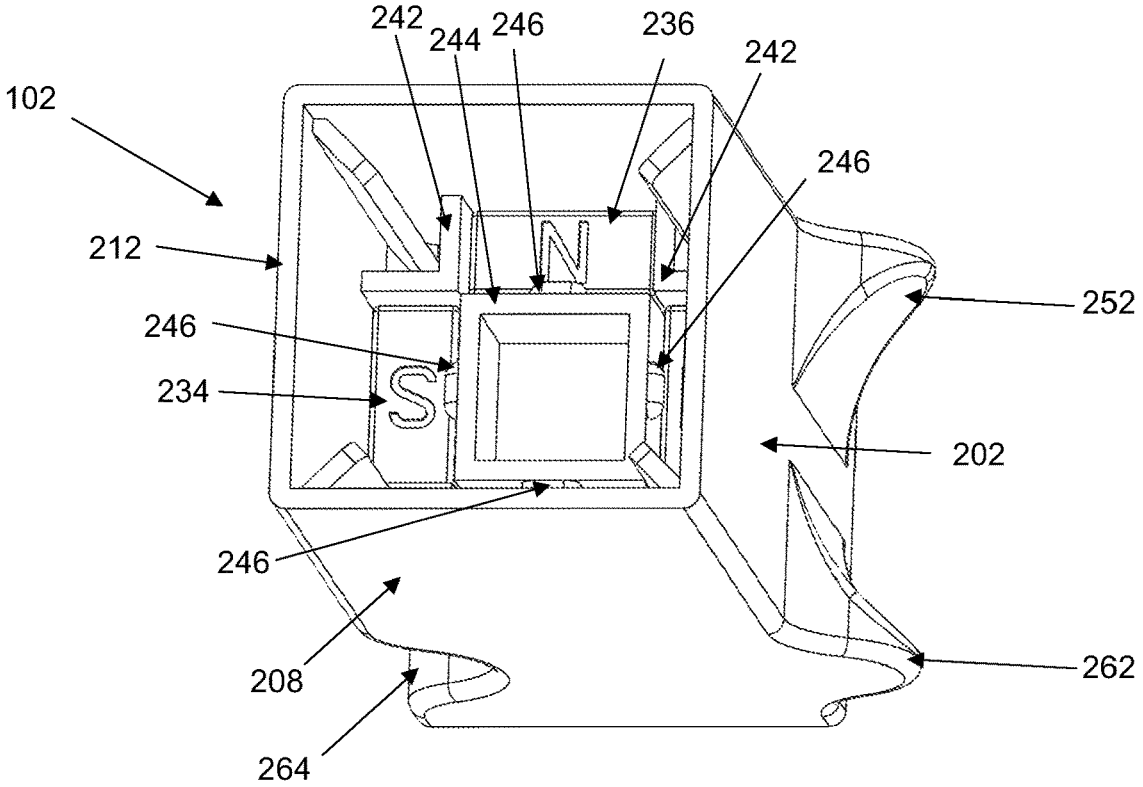
FIG. 3E illustrates a rear, top, left perspective view and magnetic connecting system of a center brick of a cosmetic holder assembly in accordance with an exemplary embodiment of the systems and devices disclosed herein.
Figure 3F:
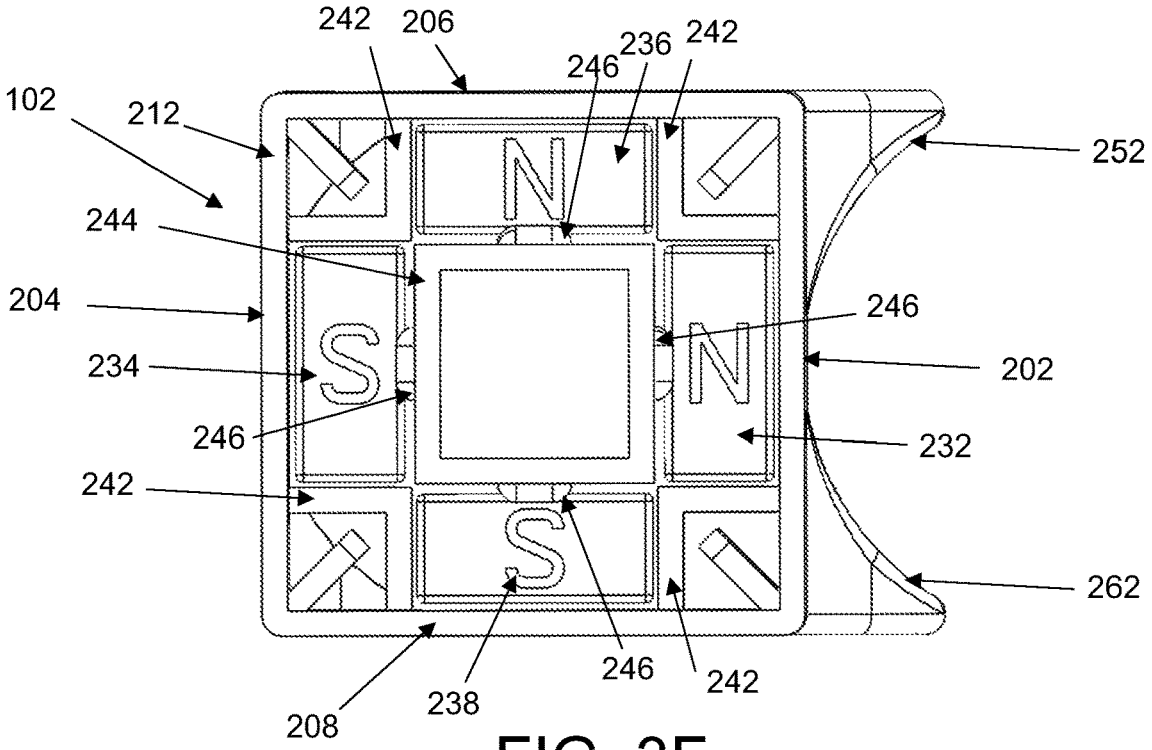
FIG. 3F illustrates a cross section of the center brick of FIG. 3A along the midpoint M and M' of a cosmetic holder assembly in accordance with an exemplary embodiment of the systems and devices disclosed herein.

Referring now to FIGS. 3E-3F, an exemplary embodiment of the magnetic connecting system of the center brick is shown. Each brick 102 includes a plurality of magnetic connectors 230, 232, 234, 236 housed inside the brick. Each of the magnetic connectors 230, 232, 234, 236 may consist of a single magnet or multiple magnets. The magnets are positioned and configured in a two-dimensional square matrix pattern such that the polarity of the magnets causes adjacent bricks to be magnetically joined together in a consistent orientation throughout the assembly.

In a preferred embodiment, the interior surfaces of the top 202, bottom 204, and sides 206, 208 of the brick define an interior housing 240 of the brick in which a plurality of permanent magnets 232, 234, 236, 238 are housed. Each magnet is housed and mounted adjacent to each interior surface, such that there is a magnet adjacent to the top interior surface, bottom interior surface, and each side interior surface. The magnets may be mounted to or near the interior walls by conventional and known methods, such as by plastic injection molding, snap-fit, adhesive, etc. As shown FIGS. 3E-3F, magnets 232, 234, 236, 238 are mounted by means of molded walls 242, 244 and snap-fit components 246 to secure the magnets in place.

Each magnet has a north (N) and south (S) polar zone, with opposite sides of each magnet having opposite polarity, such that the side of a particular magnet facing an interior surface of the brick—and potentially, an adjacent brick—is of one polarity, while the opposite side of the same magnet facing the interior of the housing is of the opposite polarity. For purposes of illustration, references to N and S in the figures indicate the polarity of the magnet side facing an interior surface of the brick—and potentially an adjacent brick.

In addition, each of two magnets housed on opposite interior surfaces of the brick are oriented such that the surface polarities of each respective magnet are reversed. That is, the side of one magnet facing an interior surface of the brick is of one polarity, while the side of the magnet facing the opposite interior surface of the brick is of the opposite polarity.

Thus, for example, as shown in FIGS. 3E-3F, a two-dimensional square matrix pattern for a set of four magnets in a center block is shown. Magnet 232 facing the interior surface of top 202 is of north polarity; magnet 234 facing the interior surface of bottom 204 is of south polarity; magnet 236 facing the interior surface of side 206 is of north polarity; and magnet 238 facing the interior surface of side 208 is of south polarity. Each identical brick in the system includes a set of magnetic connectors inside the brick positioned and configured in the same manner.

Figure 4A:
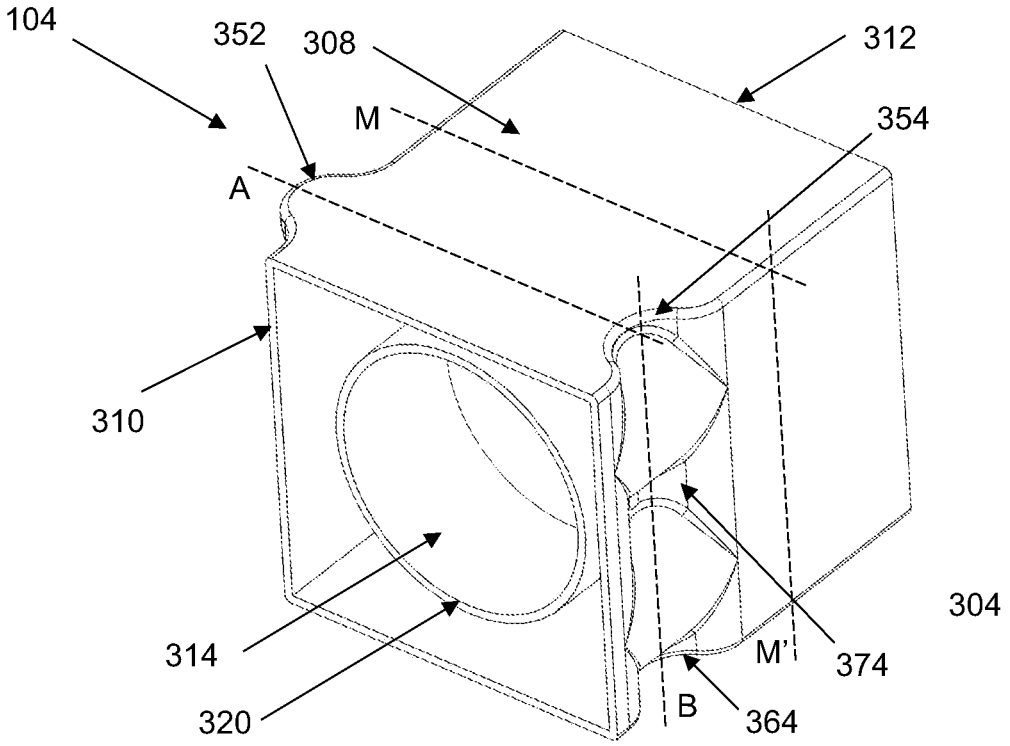
FIG. 4A illustrates a front, bottom, right perspective view of a quad center brick of a cosmetic holder assembly in accordance with an exemplary embodiment of the systems and devices disclosed herein.
Figure 4B:
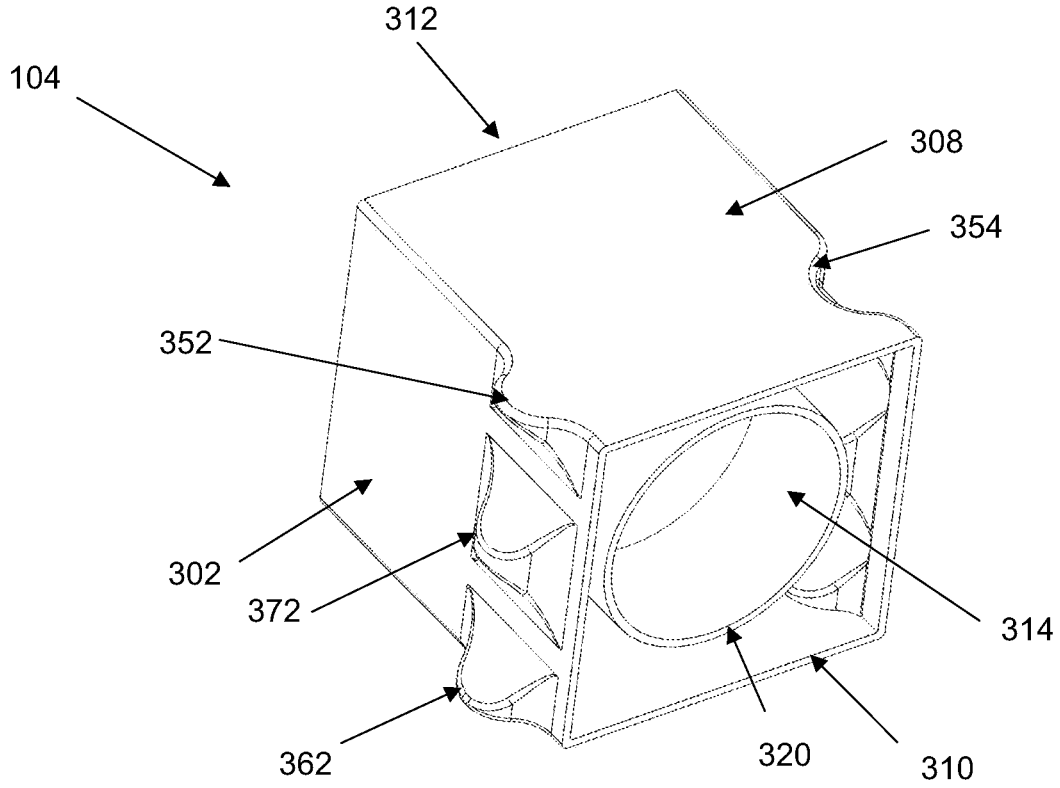
FIG. 4B illustrates a front, top, right perspective view of a quad center brick of a cosmetic holder assembly in accordance with an exemplary embodiment of the systems and devices disclosed herein.
Figure 4C:
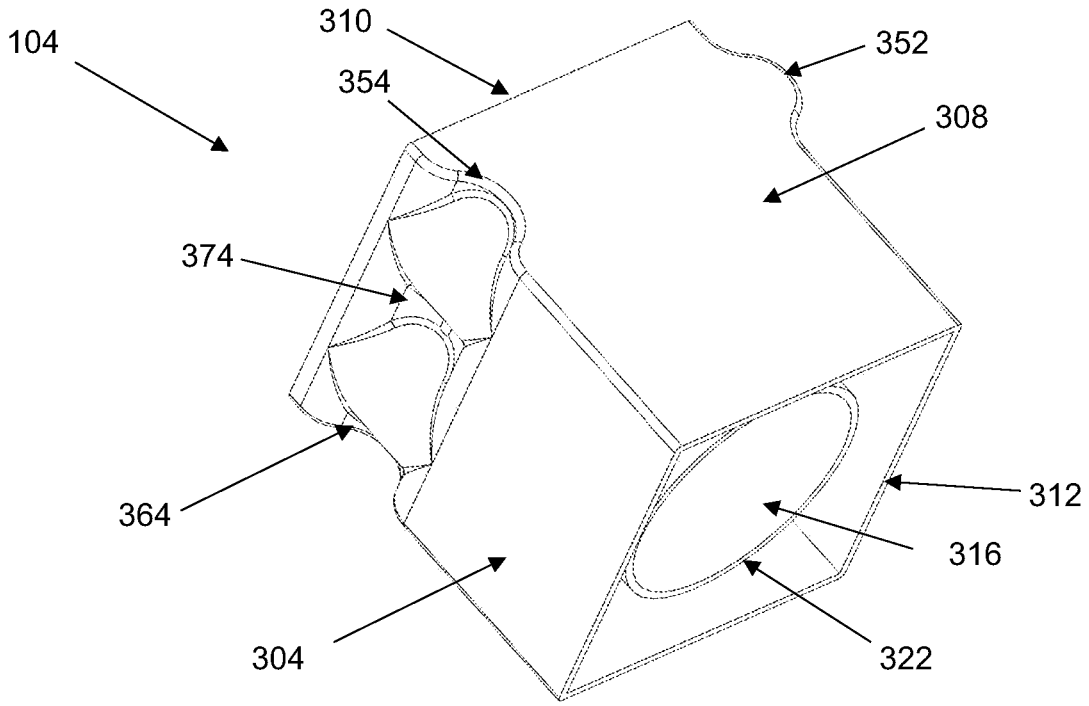
FIG. 4C illustrates a rear, bottom, right perspective view of a quad center brick of a cosmetic holder assembly in accordance with an exemplary embodiment of the systems and devices disclosed herein.
Figure 4D:
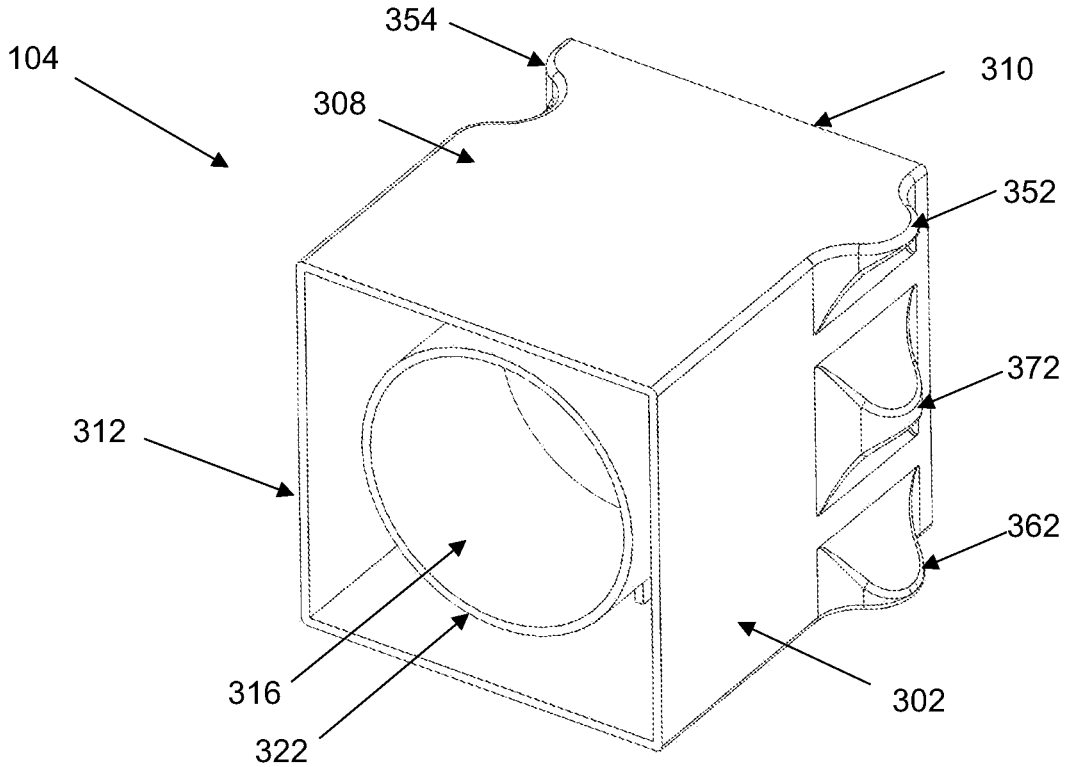
FIG. 4D illustrates a rear, top, right perspective view of a quad center brick of a cosmetic holder assembly in accordance with an exemplary embodiment of the systems and devices disclosed herein.
Figure 4E:
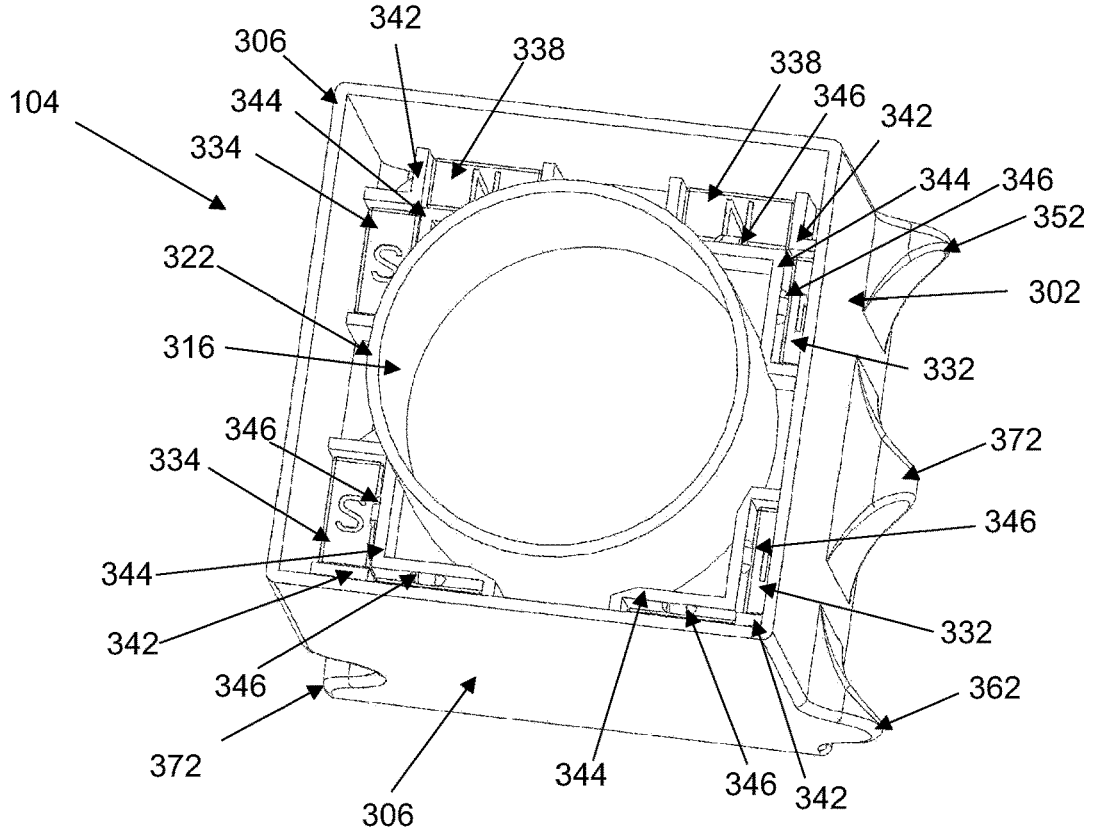
FIG. 4E illustrates a rear, top, left perspective view and magnetic connecting system of a quad center brick of a cosmetic holder assembly in accordance with an exemplary embodiment of the systems and devices disclosed herein.
Figure 4F:
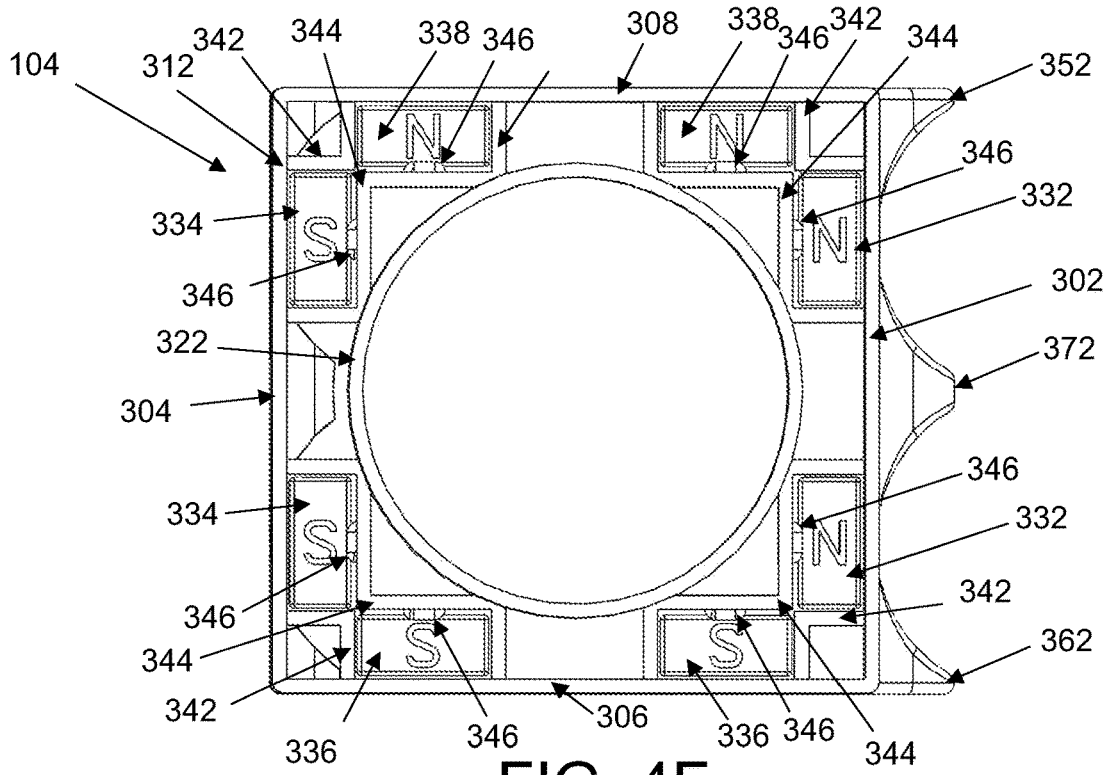
FIG. 4F illustrates a cross section of the quad center brick of FIG. 4A along the midpoint M and M' of a cosmetic holder assembly in accordance with an exemplary embodiment of the systems and devices disclosed herein.

Referring now to FIGS. 4E-4F, an exemplary embodiment of the magnetic connecting system of the quad center brick is shown. The quad brick structures and magnetic features are similar as those of the 1×1 center brick described above. Each brick 104 includes a plurality of magnetic connectors 332, 334, 336, 338 housed inside the brick. Each of the magnetic connectors 332, 334, 336, 338 may consist of a single magnet or multiple magnets. The magnets are positioned and configured in a two-dimensional square matrix pattern such that the polarity of the magnets causes adjacent bricks to be to magnetically joined together in a consistent orientation throughout the assembly. Because a quad brick's top, bottom, and side surfaces are twice the width of those of a 1×1 brick, each top, bottom, and side of a quad brick can magnetically connect with two adjacent 1×1 bricks, rather than one.

The magnets are housed and mounted in the same manner as in the 1×1 center brick. As shown FIGS. 4E-4F, magnets 332, 334, 336, 338 are mounted by means of molded walls 342, 344 and snap-fit components 346 to secure the magnets in place.

The polarities of the quad brick are similar as that of the 1×1 center brick. Thus, for example, as shown in FIGS. 4E-4F, a two-dimensional square matrix pattern for a set of four sets of magnets in a quad block is shown. Magnets 332 facing the interior surface of top 302 are of north polarity; magnets 334 facing the interior surface of bottom 204 are of south polarity; magnets 336 facing the interior surface of side 206 are of north polarity; and magnets 338 facing the interior surface of side 208 are of south polarity. Each identical brick in the system includes a set of magnetic connectors inside the brick positioned and configured in the same manner.

In a preferred embodiment, the two-dimensional square matrix for the magnets for the 1×1 or 2×2 magnets sits at or near the midpoint M and M' (shown only in FIGS. 3A and 4A) of the brick between the two ends of the brick, so as not to interfere with or obstruct the recessed cavities or sockets.

Figure 6:
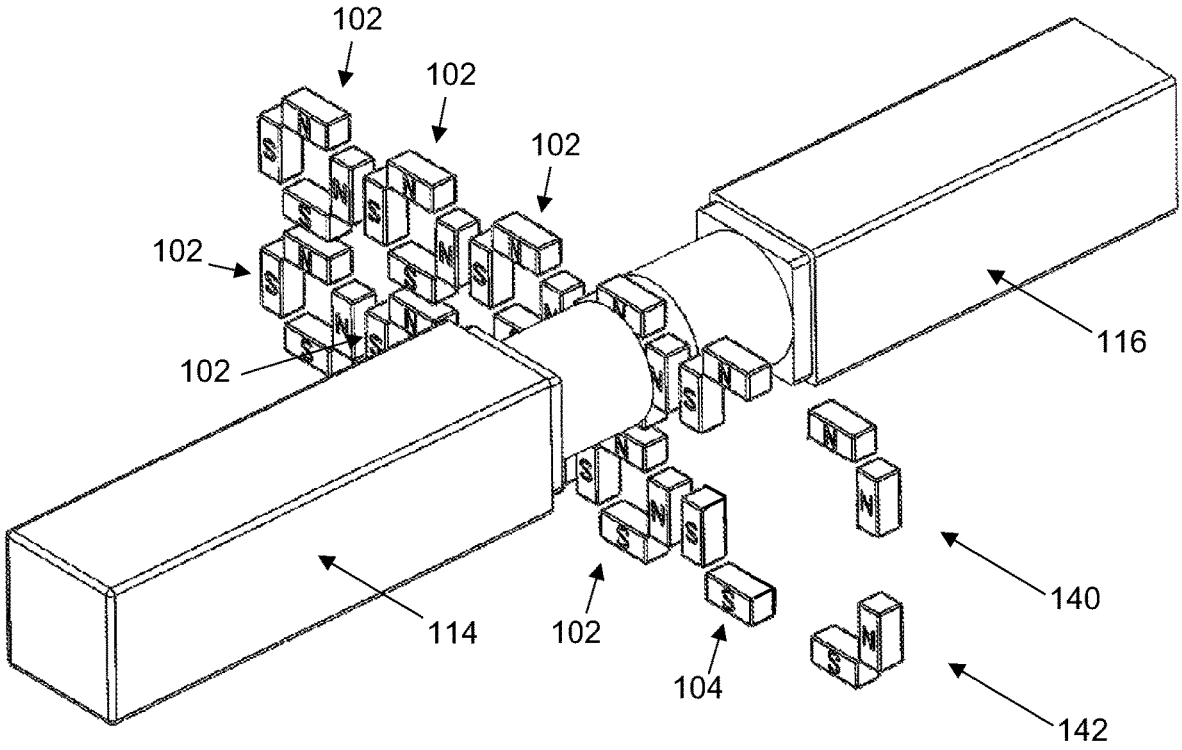
FIG. 6 illustrates a two-dimensional square matrix pattern showing the configuration of magnets in the magnetic connecting system along the cross section VI-VI of the cosmetic holding assembly of FIG. 1, with the bricks and most of the interchangeable components removed.

Referring now to FIG. 6, the configuration of magnets in a cosmetic holding assembly with the bricks and most of the interchangeable components removed is shown. All of the interchangeable components except two of them 114, 116 have been omitted for reasons of clarity. The magnets are positioned and configured in a two-dimensional square matrix pattern such that the polarity of the magnets causes adjacent bricks to be to magnetically joined together in a consistent orientation throughout the assembly.

The magnetic connectors allow bricks to be magnetically joined in both a horizontal and vertical direction. Thus, in FIG. 6, five sets of magnetic connectors join five adjacent 1×1 bricks 102 (not shown) in horizontal plane 140 to each other, while another five sets of magnetic connectors join five adjacent 1×1 bricks 102 (not shown) in horizontal plane 142 to each other, while one set of magnetic connectors join a 2×2 quad brick 104 to both horizontals rows 140, 142 of bricks. Additionally, each pair of bricks vertically adjacent above and below each other in different planes 140, 142 are also magnetically joined together, while the 2×2 quad brick 104 spans both planes. Thus, when one horizontal layer 140 of bricks is stacked vertically above or below another horizontal layer 142 of bricks, the magnetic connecting system controls the position of each layer relative to the other. Thus, the magnetic connector system controls orientation of the bricks along both a vertical and horizontal axis.

The physical keys of the bricks, as described herein, provide an additional means to control orientation of the bricks. Referring now to FIG. 3A-3F, an exemplary embodiment for the physical connecting system of the center brick is shown. The physical connecting system includes at least one set of physical keys, consisting of an indentation or notch formed on a surface and/or edge of a brick and a complementary projection or protrusion on the opposite surface and/or edge. The indentation and complementary protrusion are identical on every brick in the assembly, such that one brick can fit into an adjacent brick in an interlocking manner by joining, or inserting, an indentation on one brick with, or into, a complementary protrusion on an adjacent brick, effectively creating a male and female connecting system. The physical connecting system is described as a set of keys because the system prevents movement or rotation of adjacent bricks relative to one another.

In one embodiment, the brick includes a recessed cavity formed within the bottom 204 surface of the brick defining an indentation 254. The indentation may be formed only in the bottom surface 204 or may further extend to the edge of the bottom surface where the bottom surface and an adjacent side surface 206, 208 of the brick meet, or may further extend to the adjacent side surface as well. The brick further includes an extension formed of the top surface 202 defining a projection or protrusion 252 that is a complementary in size and shape as the indentation 254 aforedescribed. Thus, like the indentation 254, the complementary projection 252 may be formed only on the top surface 202 or may further extend to the edge of the top surface where the top surface and an adjacent side surface 206, 208 of the brick meet, or may further extend to the adjacent side surface as well. In another embodiment, the indentation 254 and projection 252 may be on the top 202 and bottom 204 surfaces respectively, or on two side surfaces 206, 208.

Preferably, the indentation and protrusion pair (male and female) 254, 252 are on the same perpendicular axis A (as shown only in FIG. 3A). Thus, a plurality of bricks each with the same indentation and protrusion pair are stackable in the same plane, such as in horizontal plane 140 or 142, with the extension of a first brick corresponding to the indentation of a second brick, such that the side surfaces 206, 208 and opposite ends 210, 212 of each brick are flush, or aligned with, with the side surfaces and opposite ends of an adjacently stacked brick.

In a preferred embodiment, a brick contains a plurality of sets of physical keys, and preferably two sets of physical keys. Preferably, the indentations for each set of keys are generally across from each other on the same surface, and preferably on the same perpendicular axis B (as shown only in FIG. 3A) across from each other on the same surface, i.e., both indentations are on the top surface, while both extensions are on the bottom surface, for example.

Thus, in a preferred embodiment, the bottom surface of a brick includes a second recessed cavity formed within the bottom surface of the brick defining a second indentation 264. The second indentation may be identical in shape and size as the first indentation 254 of the first physical key or may be of a different size and shape. Preferably, the two indentations 254, 264 are on the same end 210 of the bottom surface 204 and generally across from each other and preferably on the same perpendicular axis B across from each other. The top surface 202 of the brick includes a second extension formed of the top surface defining a projection or protrusion 262 that is complementary in size and shape as the second indentation 254 aforedescribed. As shown FIGS. 3A-3F, the indentation and protrusion pair 254, 252 and 264, 262 in the two sets of physical keys are identical.

In a preferred embodiment, the assembly may include a 2×2 sized quad brick containing three sets of physical keys. Referring now to FIG. 4A-4F, an exemplary embodiment for the physical connecting system of the quad center brick is shown. The first and second sets of keys are preferably as previously described, while the indentation and extension of the third set of key are preferably between the indentation an extensions of the first two sets. Thus, the first and second indentation and protrusion pairs 354, 352 and 364, 362 are like the indentation and protrusion pairs 254, 252 and 264, 262 in the 1×1 center brick of FIGS. 3A-3F. The third indentation and protrusions of the pairs 374, 372 are located between those of the first and second indentation and protrusion pairs 354, 352 and 364, 362, respectively. Preferably, the three indentations 354, 364, 374 are on the same end 310 of the bottom surface 304 and generally across from each other and preferably on the same perpendicular axis B across from each other.

In a preferred embodiment, the one or more sets of physical keys are offset from the midpoint M and M' (shown only in FIGS. 3A and 4A) of the center brick and quad brick on the same side of the midpoint to control the orientation of the bricks, such that adjacent bricks may stack atop one another in only a single orientation. Having the sets of physical keys offset from the midpoint prevents the ability to flip or reverse orientation of one brick relative to an adjacent brick in the same horizontal plane. Thus, flipping or reversing a brick relative to an adjacent brick will cause adjacent bricks to not assemble or join together, because the physical keys are offset from the center. Accordingly, in a horizontal plane of stacked bricks, end 210 of one brick will always be flush, or aligned with, with end 210 of an adjacently stacked brick and never flush, or aligned with, with end 212 of an adjacently stacked brick, and side 206 of one brick will always be flush, or aligned with, with side 206 of an adjacently stacked brick and never flush, or aligned with, with side 208 of an adjacently stacked brick. If there are two sets of physical keys, and each set is of different shape and size than the other set, then the two sets of physical keys may be on different sides of the midpoint of the center brick, and still cause adjacent bricks to stack atop one another in only a single orientation.

In a preferred embodiment, the physical keys are configured so as not to interfere with or obstruct the recessed cavities defining the socket. In one embodiment, the physical keys may be dimensioned and configured to join in a friction-fit manner, but they need not be.

In a preferred embodiment, the cosmetic holding assembly includes a plurality of interchangeable components of various sizes and shapes that releasably attach to the ends of the plurality of center bricks. The interchangeable components may be any of a various array of products, containers, and components for use by the user.

The interchangeable components may include containers for dispending liquid makeup, powder or cream compacts, lipstick containers, bottles for liquid skincare, bottle for liquid foundation, a glass bottle with pump for fragrance, lip gloss with applicator, mascara with applicator, a retractable blush brush, eyeshadow compact, eyeliner with retractable wand, and blush compact and self-fillable containers for brushes and cosmetic pencils.

Each type of cosmetic container is conventional and known in the art. Each conventional container type further includes attached or coupled at one end one or more posts that are dimensioned and configured to be releasably inserted into one or more corresponding complementary sockets in one or more bricks, as described above. The one or more posts may be molded to the body of the container or component or may be attached or coupled to the body by any conventional and known means, such as adhesive, socket and peg or Velcro. The posts may double as a handle or grip or may serve as an extended part of a makeup cover.

Referring now to FIGS. 2, 5C, and 7-8, an exemplary embodiment of various interchangeable components of the cosmetic holding assembly is shown. In one embodiment, the interchangeable components of the cosmetic holding assembly may include a cosmetics container bottle as shown in FIGS. 2 and 5C. The container bottle 112 may be capable of holding a liquid or powder product, such as foundation, or any other substance, including, for example, foundation, perfume, toner, cream, face wash, vitamins, tools, etc. and may be self-fillable or come pre-filled. The bottle 112 may include a container body 513 having a neck 514 and a cap. In one embodiment, the cap is the threaded snap-in cap 130 that is secured in the socket of a brick as shown in FIGS. 5A-5B. The container neck 514 may be complementarily threaded to screw onto the threaded snap-in cap 130. Thus, a container may be opened and released from the brick by unscrewing the container from the snap-in cap, and reclosed and connected to the brick by screwing the container to the snap-in cap. Alternatively, the cap may include a post molded to the cap, such that a socket of a brick may releasably receive the post in a friction-fit manner, allowing the bottle to be removed from and inserted into a socket in the brick. Thus, multiple means for connecting the bottle 112 or other component to the brick may be employed. The cap may stay on the bottle when it is removed from the brick, or the cap may remain in the brick, as with the snap-in cap 130, such that the bottle is opened when it is removed from the brick, such as by unscrewing. In a preferred embodiment, container bottle 112 is sized to attach to a 2×2 quad brick, but may be of any size suitable to perform its desired container function.

In one embodiment, the interchangeable components of the cosmetic holding assembly may include a lipstick container, as shown in FIGS. 2 and 5C. The lipstick container 116 may include a lipstick casing 533, which holds the lipstick bullet 534, and a protective covering 535, which attaches to the lipstick casing to store and protect the lipstick contained therein. The covering may include a post 532 molded to the covering, such that that lipstick container may be releasably attached to the brick 102. Alternatively, the post 532 may be molded to the lipstick casing 533 instead, such that the lipstick container is attached casing-first to the brick. In FIG. 5C, the protective covering 535 portion of the lipstick container 116 is shown inserted into the brick 102, while the lipstick casing is 533 is detached from the covering. A user may optionally decide to first remove the entire lipstick container 116 from the brick 102, then detach protective covering 535 from the lipstick casing 533.

Figure 8A:
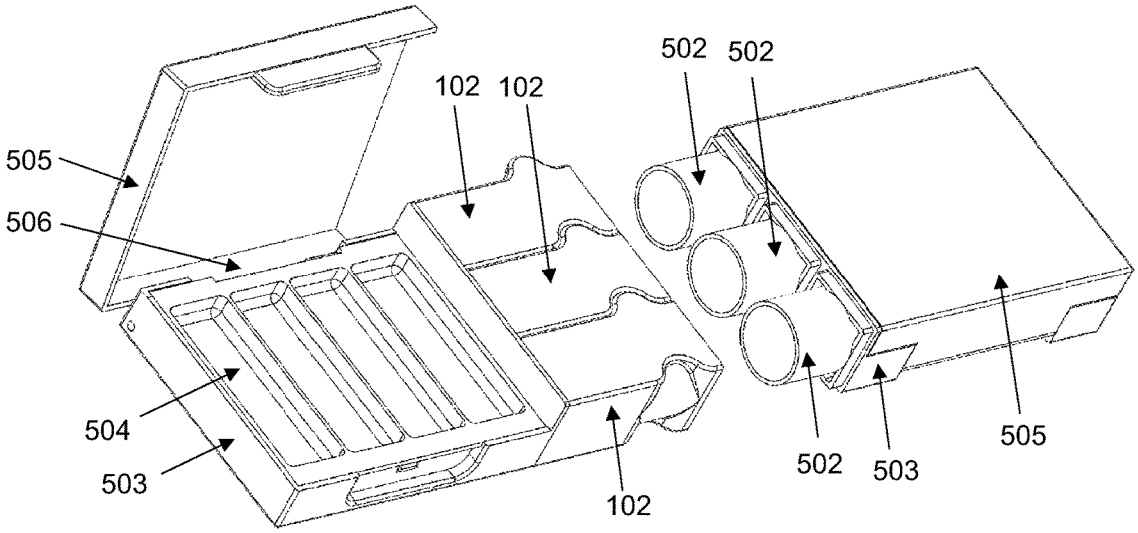
FIGS. 8A-8B illustrate a compact container of the cosmetic holding assembly in accordance with an exemplary embodiment of the systems and devices disclosed herein.
Figure 8B:
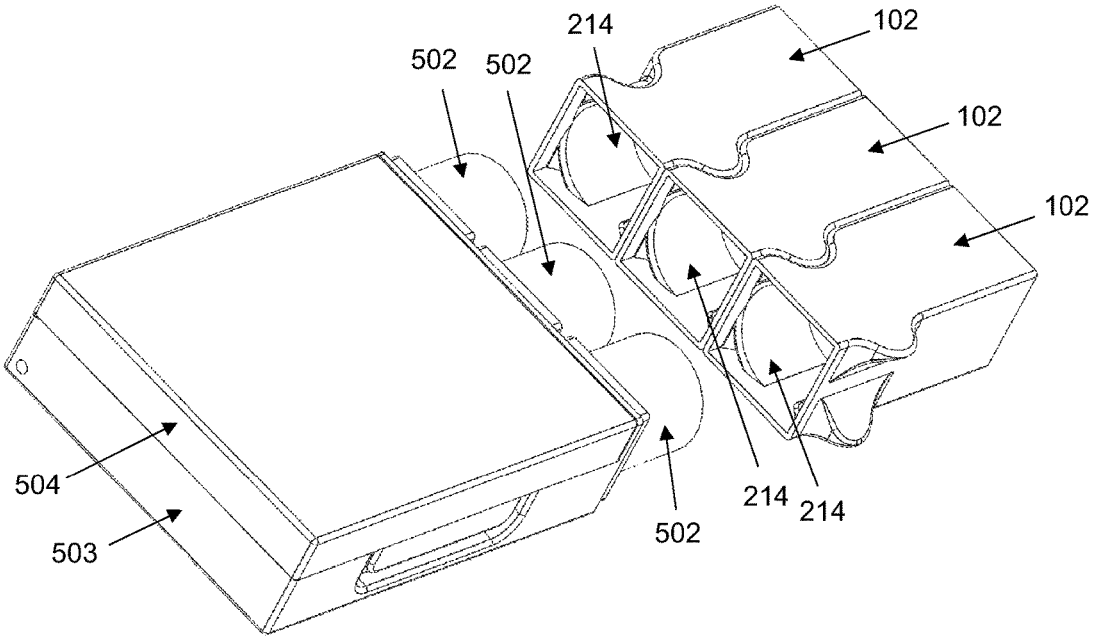

In one embodiment, the interchangeable components of the cosmetic holding assembly may include a compact container, as shown in FIGS. 2 and 8A-8B. The compact container 110 may include a base 503, which contains a makeup tray 504 and a lid 505 attached to the base with a hinge 506 to open and close the container. The base may include a one or more posts 502 molded to the base, such that the compact container may be releasably attached to one or more adjacent bricks 102 by inserting the one or more posts 502 into one or more corresponding complementary sockets 214, 216 on adjacently joined bricks. In this manner, the cosmetic assembly kit can accommodate a compact container, or any other component, of various lengths and sizes, by having any number of posts in any arrangement suitable to attach the component to the center bricks. The posts of the compact, as with any posts described herein, may be hollow, solid, open, or enclosed.

Figure 7A:
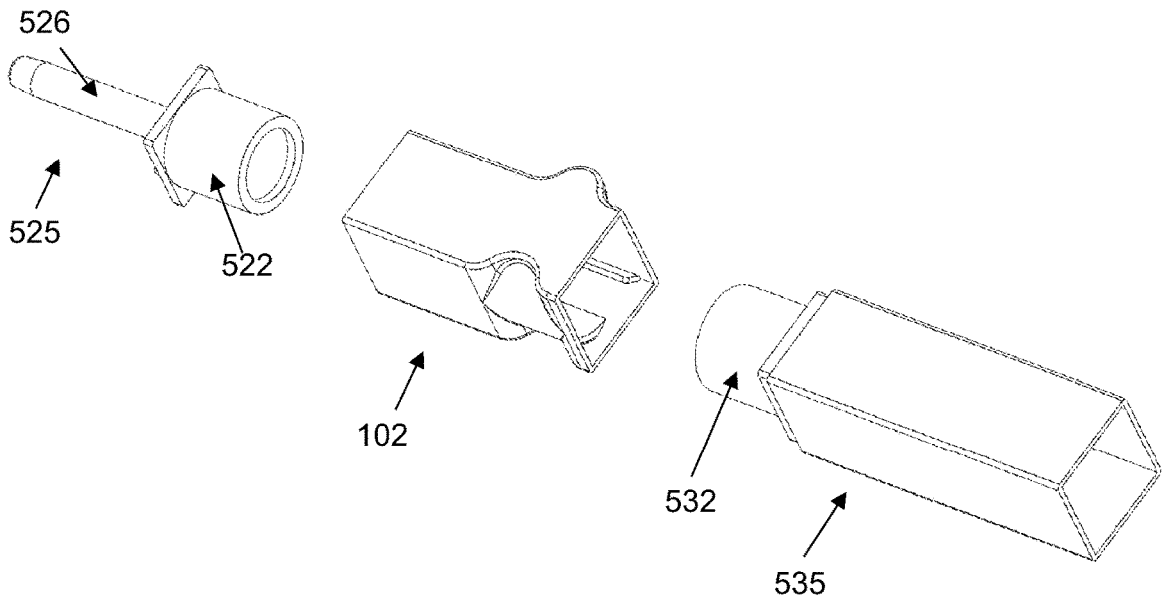
FIGS. 7A-7B illustrate a center brick and selected components of a cosmetic holding assembly in accordance with an exemplary embodiment of the systems and devices disclosed herein.
Figure 7B:
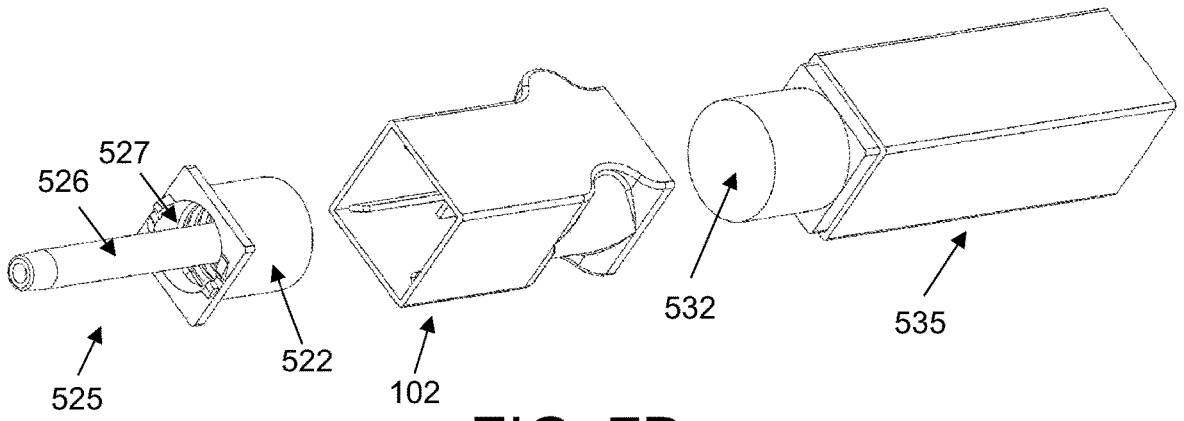

In one embodiment, the interchangeable components of the cosmetic holding assembly may include a container with applicator, as shown in FIGS. 2 and 7A-7B. The container with applicator 114 may include a container body 523 having a neck 524 and a separate applicator cap 525 that releasably attaches to the neck, such as by a screw or friction fit. The applicator cap may include an applicator 526, which may also be a wand or brush or other device for applying makeup, that is attached to the cap 525 through a recess 527 in the cap. The recess may be threaded to screw to the container body neck. The applicator cap may include a grip handle 522 that doubles as a post by which the container with applicator 114 may be releasably attached to the brick.

Although various types of cosmetic container are discussed herein, the system and devices disclosed herein may include other types of cosmetics container and is therefore not limited thereto. Although discussed herein in the context of cosmetics, the systems and devices disclosed herein may include other types of containers, components, products, and is therefore not limited thereto.

Figure 9:
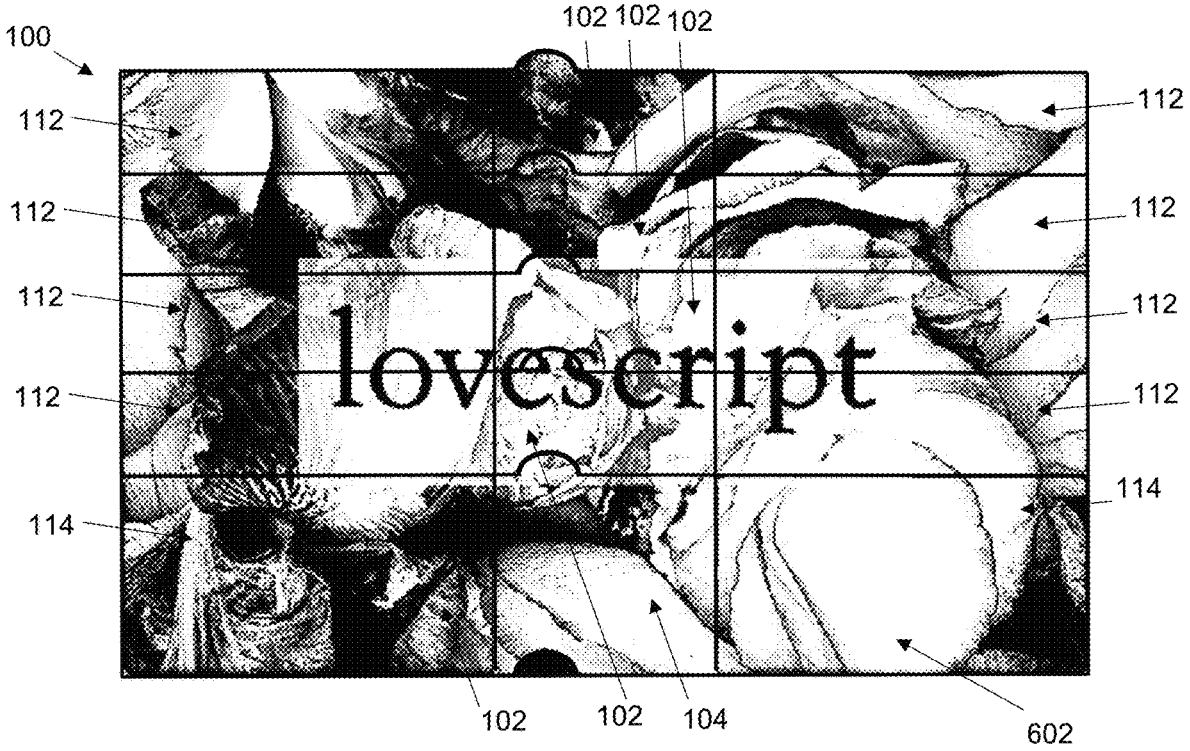
FIG. 9 illustrates a cosmetic holder assembly having a graphic image in accordance with an exemplary embodiment of the systems and devices disclosed herein.

Referring now to FIG. 9, an exemplary embodiment for a graphic image feature of the cosmetic holding assembly is shown. In one embodiment, the cosmetic holder assembly 100 includes a decoration or graphic image 602 that spans across the face of multiple bricks 102, 104 and components 112, 114 of a fully assembled assembly. The graphic image 602 may include characters, text, letters, numbers, shapes, symbols, a logo or trademark, photographs, drawings, graphics, illustrations, designs, or other artwork, texture, pattern, or any two- or three-dimensional feature that can be applied to a surface, and combinations thereof. The graphic image may function like a jigsaw puzzle to help the user reassemble the kit in the correct orientation, providing an additional toy-like feature to the assembly. Furthermore, the indentation and protrusions of the physical key(s) act as an additional visual cue to help the user assemble the kit with little to no trial and error. The opposite face of the assembly made include another graphic image as well. Thus, the graphic image provides an additional means, in conjunction with the magnetic connectors and physical keys of the assembly, to control the orientation of the holding assembly.

Figure 10:
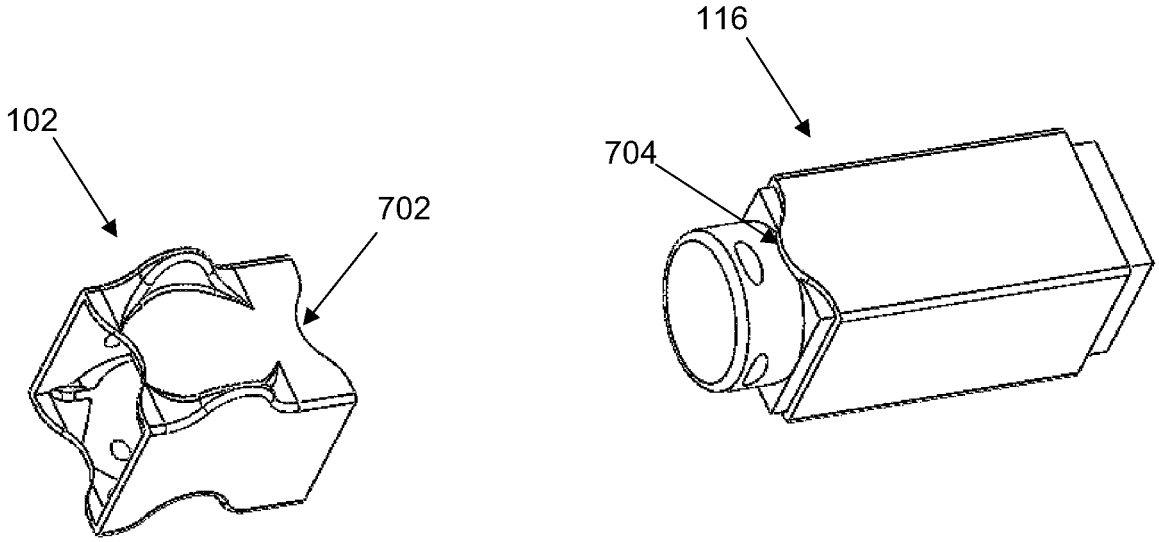
FIG. 10 illustrates a center brick and selected components of a cosmetic holding assembly in accordance with another exemplary embodiment of the systems and devices disclosed herein.

Referring now to FIG. 10, an exemplary embodiment for an alignment feature of the system and device is shown. In one embodiment, the units and interchangeable components (such as, for example, lipstick container 116) may include an alignment feature 702, 704 to provide a visual or tactile cue to indicate the proper orientation for aligning a unit with an interchangeable component, thus providing a guide to the user of how the unit and component are to fit together. The alignment feature may be included in conjunction with a decoration 602 as a further cue to indicate how units and components should be assembled relative to each other, or it may be included on its own without the decoration. In one embodiment, the alignment feature 702, 704 is incorporated into the post and socket connection section of the unit and components. The alignment feature may include on either of the unit and component an indentation, projection, wave, divot, mark, notch, icon, symbol, or any other feature which provides a visual or tactile cue, and may include a corresponding, complementary, or matching aligning feature 702, 704 on another unit or component with which the first unit or component may to be aligned.

While the embodiments described herein disclose the socket on the center brick and the posts on the components that releasably attach to the brick, it is to be appreciated that various modification to the location of the sockets and posts on the center bricks and components, and of any other elements for that matter, may be made to the present invention, while still allowing for the performance of the functions described herein. For example, the post on the container and the socket on the brick may be reversed—that is, the posts may extend from opposite ends of the brick, while the complementary sockets may be defined by a recessed cavity formed within the container or a component thereof, such as in the cap of a container.

In a preferred embodiment, the bricks are plastic and manufactured using conventional injection molding techniques. The bricks and components may be singularly molded plastic parts or consist of multiple parts assembled using conventional snap-fit assembly methods known in the art. Container components may be plastic or glass, flexible or rigid. Any material suitable for manufacturing the parts of the cosmetic holding assembly may be used.

In a preferred embodiment, the assembly may include components and bricks of various sizes, and thus be scalable to allow for the attachment of products or components of various sizes. Thus, one size component may be capable of attaching to one brick, while another size component may be capable of attaching to a plurality of adjacent bricks assembled in a grid of various sizes, such as 2×1, or 3×1, or 2×2, while yet another size component may be capable of attaching to a single brick that is equivalent in size to a 2×2 grid of bricks. By example and without limitation, the assembly may contain any of the following component and brick size combination: one component having one post to join one 1×1 brick; one component having two posts to join two adjacent 1×1 bricks; one component having three posts to joint three adjacent 1×1 bricks; one component having four posts to join four adjacent 1×1 bricks stacked in a 2×2 grid; and one component having one large 2×2 size cap to join one 2×2 brick. The combinations and patterns described herein allow for components of any size.

It is to be appreciated that various modification may be made to the present invention and such modification will be apparent to those skilled in the art. For example, although cosmetic containers, and containers and components, more generally are disclosed, any set or combination of objects, devices, tools, apparatuses, or instruments to which a post can be attached to each item in the set does not depart from the spirit and scope of the invention. Thus, the spirit and scope of the invention covers a wide variety of applications that would benefit from being able to releasably hold multiple items together in an assembly.

For example, in an application in one embodiment, the holding assembly may include a set of tools, such as screwdrivers of various sizes and types, e.g., Phillips, flat head, torx, hex, etc. In one embodiment, the handle of the screwdriver may include the post, with the shank and screwdriver tip extending outward from the center brick. In another embodiment, the screwdriver shank may include an elongated covering into which a screwdriver may be inserted, and the covering may include a post for releasably inserting into the center brick. In another embodiment, the center brick may contain elongated sockets that serves as a housing for receiving the screwdriver, with the base of the screwdriver handle configured as a post.

Other applications may include kits of crayons, markers, or other writing instruments that come in various colors; makeup kits of a variety of makeup brushes, and essentially any set of similar or related, or even unrelated objects, or storage kits provided empty for a user to fill with items of their choice, such as vitamin. Other applications may include uses that only require the forced orientation caused by the magnetic connecting system and physical keys, without a need for interchangeable containers or attachments to hold anything. The dimensions of the center bricks may be of any length, height, and width, suitable for performing the functions described herein for any particular application.

Thus, while there have been shown and described and pointed out fundamental novel features of the cosmetic holding assembly as applied to preferred embodiments thereof, it will be understood that various omissions and substitutions and changes in the form and details of the cosmetic holding assembly illustrated, and in its operation, may be made by those skilled in the art without departing from the spirit of the disclosure. For example, it is expressly intended that all combinations of those elements and/or method steps which perform substantially the same function in substantially the same way to achieve the same results are within the scope of the application. It is the intention, therefore, to be limited only as indicated by the scope of the claims appended hereto.

What is claimed is:

1. A system for releasably connecting a plurality of interchangeable components in an assembly, the system comprising:

a plurality of units, wherein each of the plurality of units comprises a first exterior surface, a second exterior surface, a first interior surface, a second interior surface, an interior housing of the unit defined by at least the first and second interior surfaces, and a first end comprising a first coupling component, and a plurality of interchangeable components, wherein each of the interchangeable components comprises a second coupling component capable of being releasably joined to one or more of the plurality of units, the plurality of units further comprising a physical connecting system for relative positioning of at least one of the plurality of units with at least another one of the plurality of units comprising a first set of physical keys on each of the plurality of units, the first set of physical keys comprising a first indentation on the first exterior surface of the unit, and a first projection on the second exterior surface of the unit and dimensionally complementary to the first indentation, wherein the first projection on one of the plurality of units is capable of fitting into the first indentation on another one of the plurality of units, such that the physical connecting system is capable of causing at least one of the plurality of units to be releasably joined to another one of the plurality of units along a first plane, and a magnetic connecting system for relative positioning of at least one of the plurality of units with at least another one of the plurality of units comprising a plurality of magnetic connectors housed in the interior housing of each of the plurality of units, wherein each of the magnetic connectors has two magnetic polar zones having opposite polarity, the plurality of magnetic connectors comprising a first magnet housed adjacent to the first interior surface of the unit, and a second magnet housed adjacent to the second interior surface of the unit, wherein the first magnet comprises a first face facing the first interior surface and having a first polarity, and the second magnet comprises a second face facing the second interior surface and having a second polarity opposite the first polarity, such that the magnetic connecting system is capable of causing at least one of the plurality of units to be magnetically joined to another one of the plurality of units along the first plane.

2. The system of claim 1, wherein each of the plurality of units further comprises a third interior surface and fourth interior surface, and the interior housing of the unit is further defined by at least the third interior surface and fourth interior surface, and the plurality of magnetic connectors further comprises a third magnet housed adjacent to the third interior surface of the unit, and a fourth magnet housed adjacent to the fourth interior surface of the unit, wherein the third magnet comprises a third face facing the third interior surface and having a polarity the same as the polarity of the first face, and the fourth magnet comprises a fourth face facing the fourth interior surface and having a polarity opposite the polarity of the third face and the same as the polarity of the second face, such that the magnetic connecting system is further capable of causing at least one of the plurality of units to be magnetically joined to another one of the plurality of units along a second plane perpendicular to the first plane.

3. The system of claim 1, wherein each of the plurality of magnetic connectors are located at about a midpoint of the unit.

4. The system of claim 1, wherein the first indentation and first projection are on a first axis of the unit perpendicular to the first and second exterior surfaces.

5. The system of claim 1, wherein the physical connecting system comprises a second set of physical keys on each of the plurality of units comprising:

a second indentation on the first exterior surface of the unit, a second projection on the second exterior surface of the unit and dimensionally complementary to the second indentation, wherein the second indentation and second projection are on a second axis of the unit perpendicular to the first and second exterior surfaces and parallel to the first axis wherein the second projection on one of the plurality of units is capable of fitting into the second indentation on another one of the plurality of units such that the physical connecting system is capable of causing at least one of the plurality of units to be releasably joined to another one of the plurality of units along the first plane.

6. The system of claim 5, wherein the first and second indentations are generally across from each other on the first exterior surface and the first and second projections are generally across from each other on the second exterior surface.

7. The system of claim 1, wherein the first set of physical keys is offset from about a midpoint of the unit.

8. The system of claim 1, wherein the first coupling component on each of the plurality of units comprises a recessed cavity within the unit defining a socket dimensioned and configured to be releasably coupled to a complementarily dimensioned and configured post on each of the interchangeable components and the second coupling component on each of the interchangeable components comprises one or more posts dimensioned and configured to be releasably coupled to one or more complementarily dimensioned and configured sockets in the one or more of the plurality of units.

9. The system of claim 1, wherein the plurality of units further comprises a first group of one or more units whose first and second exterior surfaces are each of a fixed length and a second group of one or more units whose first and second exterior surfaces are each of a length that is a whole number multiple of the fixed length.

10. The system of claim 9, wherein each of the plurality of units further comprises a third and fourth exterior surface and the third and fourth exterior surfaces of the first group of one or more units are of a fixed length and the third and fourth exterior surfaces of the second group of one or more units are of a length that is a whole number multiple of the fixed length.

11. The system of claim 1, wherein the magnetic connectors in the magnetic connecting system are positioned and configured in a two-dimensional square matrix pattern such that the polarity of the magnetic connectors causes adjacent units to be magnetically joined together in a consistent orientation throughout the assembly.

12. The system of claim 1, wherein the physical connecting system is configured to prevent rotation of adjacent units relative to one another.

13. The system of claim 1, further comprising a decoration that, when the assembly is in an assembled configuration, spans across at least a portion of a face of the assembly, wherein the face of the assembly comprises a surface of at least one of the plurality of units and a surface of at least one of the plurality of interchangeable components, wherein the decoration provides a means to control orientation of the plurality of units and plurality of interchangeable components.

14. The system of claim 13, wherein the decoration is selected from the group consisting of logos, trademarks, graphics, illustrations, photographs, drawings, designs, or other artwork, characters, text, letters, numbers, shapes, symbols, and combinations thereof.

15. The system of claim 1, wherein the interchangeable components comprise cosmetics and personal care products and containers configured for holding and dispensing cosmetics and personal care products.

16. The system of claim 1, wherein the unit is generally in the shape of a rectangular brick.

17. A system for releasably connecting a plurality of interchangeable components in an assembly, the system comprising:

a plurality of units, wherein each of the plurality of units comprises a first exterior surface, a second exterior surface, a first interior surface, a second interior surface, a third interior surface, a fourth interior surface, an interior housing of the unit defined by at least the first, second, third and fourth interior surfaces, and a first end comprising a first coupling component, and a plurality of interchangeable components, wherein each of the interchangeable components comprises a second coupling component capable of being releasably joined to one or more of the plurality of units, the plurality of units further comprising a physical connecting system for relative positioning of at least one of the plurality of units with at least another one of the plurality of units comprising a first set of physical keys on each of the plurality of units, the first set of physical keys comprising a first indentation on the first exterior surface of the unit, and a first projection on the second exterior surface of the unit and dimensionally complementary to the first indentation, wherein the first projection on one of the plurality of units is capable of fitting into the first indentation on another one of the plurality of units, such that the physical connecting system is capable of causing at least one of the plurality of units to be releasably joined to another one of the plurality of units along a first plane, and a magnetic connecting system for relative positioning of at least one of the plurality of units with at least another one of the plurality of units comprising a plurality of magnetic connectors housed in the interior housing of each of the plurality of units, wherein each of the magnetic connectors has two magnetic polar zones having opposite polarity, the plurality of magnetic connectors comprising a first magnet housed adjacent to the first interior surface of the unit, a second magnet housed adjacent to the second interior surface of the unit, a third magnet housed adjacent to the third interior surface of the unit, and a fourth magnet housed adjacent to the fourth interior surface of the unit, wherein the first magnet comprises a first face facing the first interior surface and having a first polarity, the second magnet comprises a second face facing the second interior surface and having a second polarity opposite the first polarity, the third magnet comprises a third face facing the third interior surface and having a polarity the same as the polarity of the first face, and the fourth magnet comprises a fourth face facing the fourth interior surface and having a polarity opposite the polarity of the third face and the same as the polarity of the second face, such that the magnetic connecting system is capable of causing at least one of the plurality of units to be magnetically joined to another one of the plurality of units along the first plane and to another one of the plurality of units along a second plane perpendicular to the first plane.

18. The system of claim 17, further comprising a decoration that, when the assembly is in an assembled configuration, spans across at least a portion of a face of the assembly, wherein the face of the assembly comprises a surface of at least one of the plurality of units and a surface of at least one of the plurality of interchangeable components, wherein the decoration provides a means to control orientation of the plurality of units and plurality of interchangeable components.

19. A system for releasably connecting a plurality of interchangeable components in an assembly, the system comprising:

a plurality of units, wherein each of the plurality of units comprises a first exterior surface, a second exterior surface, a first interior surface, a second interior surface, a third interior surface, a fourth interior surface, an interior housing of the unit defined by at least the first, second, third and fourth interior surfaces, and a first end comprising a first coupling component, and a plurality of interchangeable components, wherein each of the interchangeable components comprises a second coupling component capable of being releasably joined to one or more of the plurality of units, the plurality of units further comprising a physical connecting system for relative positioning of at least one of the plurality of units with at least another one of the plurality of units comprising a first set of physical keys on each of the plurality of units, the first set of physical keys comprising a first indentation on the first exterior surface of the unit, and a first projection on the second exterior surface of the unit and dimensionally complementary to the first indentation, wherein the first projection on one of the plurality of units is capable of fitting into the first indentation on another one of the plurality of units, such that the physical connecting system is capable of causing at least one of the plurality of units to be releasably joined to another one of the plurality of units along a first plane, and a magnetic connecting system for relative positioning of at least one of the plurality of units with at least another one of the plurality of units comprising a plurality of magnetic connectors housed in the interior housing of each of the plurality of units, wherein each of the magnetic connectors has two magnetic polar zones having opposite polarity, the plurality of magnetic connectors comprising a first magnet housed adjacent to the first interior surface of the unit, a second magnet housed adjacent to the second interior surface of the unit, a third magnet housed adjacent to the third interior surface of the unit, and a fourth magnet housed adjacent to the fourth interior surface of the unit, wherein the first magnet comprises a first face facing the first interior surface and having a first polarity, the second magnet comprises a second face facing the second interior surface and having a second polarity opposite the first polarity, the third magnet comprises a third face facing the third interior surface and having a polarity the same as the polarity of the first face, and the fourth magnet comprises a fourth face facing the fourth interior surface and having a polarity opposite the polarity of the third face and the same as the polarity of the second face, such that the magnetic connecting system is capable of causing at least one of the plurality of units to be magnetically joined to another one of the plurality of units along the first plane and to another one of the plurality of units along a second plane perpendicular to the first plane, and a decoration that, when the assembly is in an assembled configuration, spans across at least a portion of a face of the assembly, wherein the face of the assembly comprises a surface of at least one of the plurality of units and a surface of at least one of the plurality of interchangeable components, wherein the decoration provides a means to control orientation of the plurality of units and plurality of interchangeable components.

* * * * *